US007193181B2

(12) United States Patent
Makihira et al.

(10) Patent No.: US 7,193,181 B2
(45) Date of Patent: Mar. 20, 2007

(54) IMAGE HEATING APPARATUS AND HEATER USED THEREFOR

(75) Inventors: Tomoyuki Makihira, Ashigara-gun (JP); Hiroshi Takami, Odawara (JP); Hiroaki Sakai, Mishima (JP); Akira Kato, Mishima (JP); Atsushi Iwasaki, Mishima (JP); Yasunari Kobaru, Numazu (JP); Masaru Tsukada, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 105 days.

(21) Appl. No.: 11/154,546

(22) Filed: Jun. 17, 2005

(65) Prior Publication Data

US 2006/0000819 A1 Jan. 5, 2006

(30) Foreign Application Priority Data

Jun. 21, 2004 (JP) ..... 2004-182417
May 24, 2005 (JP) ..... 2005-151019

(51) Int. Cl.
*G03G 15/20* (2006.01)
*H05B 3/02* (2006.01)

(52) U.S. Cl. ..... 219/216; 399/329

(58) Field of Classification Search ..... None
See application file for complete search history.

(56) References Cited

U.S. PATENT DOCUMENTS 5,068,517 A * 11/1991 Tsuyuki et al. ..... 219/553
5,682,576 A 10/1997 Sakai et al. ..... 399/69
5,904,871 A 5/1999 Sakai et al. ..... 219/216
6,094,559 A 7/2000 Otsuka et al. ..... 399/327
6,151,462 A 11/2000 Fukuzawa et al. ..... 399/67
6,175,699 B1 1/2001 Kato et al. ..... 399/69
6,185,383 B1 * 2/2001 Kanari et al. ..... 399/329
6,438,348 B2 8/2002 Kobaru et al. ..... 399/333
6,469,279 B1 10/2002 Ohtsuka ..... 219/216
6,516,165 B2 2/2003 Makihira et al. ..... 399/69

(Continued)

FOREIGN PATENT DOCUMENTS

JP 9-297478 11/1997
JP 10-177319 6/1998

*Primary Examiner*—Joseph Pelham
(74) *Attorney, Agent, or Firm*—Fitzpatrick, Cella, Harper & Scinto

(57) ABSTRACT

The image heating apparatus for heating an image formed on a recording material includes a heater having a substrate and first and second heat generating resistors, most of the region of said first heat generating resistor having smaller resistance value per unit length toward an end in the longitudinal direction of said substrate, and most of the region of said second heat generating resistor having larger resistance value per unit length toward the end part; wherein a safety element can control electrical power supply to said first heat generating resistor and electrical power supply to said second heat generating resistor individually, and operates in response to the heat of said heater to cut off electrical power supply to said first and second heat generating resistors; and wherein only said second heat generating resistor in said first and second heat generating resistors has a high resistance part high resistance part corresponding to said safety element in a part in the longitudinal direction thereof; and consequently, this can provide an image heating apparatus that can cut off electrical power supply quickly when a heater has run away and to provide a heater to be used in this apparatus.

38 Claims, 12 Drawing Sheets

U.S. PATENT DOCUMENTS 6,583,389 B2 * 6/2003 Murooka et al. ..... 219/216
6,614,004 B2 * 9/2003 Moriya et al. ..... 219/216
6,713,725 B2 * 3/2004 Izawa et al. ..... 219/216
6,734,397 B2 5/2004 Kato et al. ..... 219/216
6,754,458 B2 6/2004 Makihira ..... 399/92
6,947,679 B2 9/2005 Kato et al. ..... 399/45
7,027,763 B2 4/2006 Kato et al. ..... 399/329
2004/0131374 A1 7/2004 Sakai ..... 399/68
2005/0258158 A1 11/2005 Takami et al. ..... 219/216
2005/0280682 A1 12/2005 Kato et al. ..... 347/102
2006/0000819 A1 1/2006 Makihira et al. ..... 219/216
2006/0024071 A1 2/2006 Takami ..... 399/33
2006/0045589 A1 3/2006 Iwasaki et al. ..... 399/328
2006/0067750 A1 3/2006 Inoue et al. ..... 399/328

* cited by examiner

IMAGE HEATING APPARATUS AND HEATER USED THEREFOR

BACKGROUND OF THE INVENTION

1. Field of the Invention

The present invention relates to an image heating apparatus suitable for use as a heat fixing apparatus mounted on photocopiers and printers as well as a heater used in the apparatus.

2. Related Background Art

As a heat fixing apparatus mounted on a photocopier or a printer, the one which comprises a flexible sleeve, a ceramic heater brought into contact with the inner surface of the flexible sleeve and a pressure roller forming a nip portion with the ceramic heater by sandwiching the flexible sleeve and is configured to convey recording material carrying toner images with a nip portion and meanwhile bring the toner images into heat fixing onto the recording material has been put into practical use. The heat fixing apparatus (called film heating system) has a very small heat capacity, and therefore is advantageous in terms of short warmingup to reach the fixable temperature to make short a period of waiting for printing and of less power consumption under the state of waiting for a print instruction and the like.

The quality of material for the flexible sleeve is polyimide or stainless. In addition, the ceramic heater is a plate-shaped ceramic substrate excellent in heat-resisting property, heat conducting property and electro-insulating property, made of almina, aluminium nitride and the like, on which a heat generating resistor with silver and paradium as main components is printed. Based on detection temperature of a thermistor brought into contact with this ceramic heater, electrical power supply to the heat generating resistor is controlled to supervise the temperature of the heater.

Such a heat fixing apparatus is provided with safety measures in assumption of the case where a circuit controlling heat dissipation of the ceramic heater ends in giving up normal operation due to some causes. In particular, between the power supply and the heat generating resistor an safety element (heat sensing element) such as a thermoswitch, a temperature fuse and the like are brought into electrical connection and this safety element is brought into contact with the ceramic heater. In the case where the heat generating resistor has run away (in the case where the ceramic heater has given rise to abnormal heat dissipation), the heat from the ceramic heater operates the safety element to open the electric path from the power supply to the heat generating resistor so as to cut off electrical power supply to the heat generating resistor, and thereby abnormal temperature rise of the ceramic heater is prevented. Here, in case of a toner image formed on a small-sized recording material into heat fixing, in the direction perpendicular to the recording material conveyance direction, in the region where recording material passes the heat of the ceramic heater is deprived by the recording material, but in the region where recording material does not pass, the heat of the ceramic heater is not deprived by the recording material and therefore excess temperature might take place (generally called temperature rise in non-paper feeding portion). The safety element is normally disposed within the region where a small-sized recording material passes so that the safety element do not operating by this temperature rise in non-paper feeding portion.

Incidentally, the safety element such as a thermoswitch, a temperature fuse and the like has heat capacitance to a certain extent. Accordingly, in the region where the safety element is brought into contact with the ceramic heater, since the heat is deprived by the safety element, the temperature readily drops. On the contrary, in the region where the safety element is not brought into contact, absence of heat transfer to the safety element readily gives rise to unevenness of temperature distribution between in the region where safety element is brought into contact and in the region where safety element is not brought into contact.

Accordingly, a technique for correcting unevenness of temperature distribution due to existence of a safety element has been disclosed in Japanese Patent Application Laid-Open No. H09-297478. In particular, in the technique, the resistance value of a heat generating resistor in the region where an safety element is brought into contact is made larger than the resistance value of the adjacent region so as to make the heat dissipation amount of the region where an safety element is brought into contact larger than the adjacent region and thereby the heat deprived by the safety element is compensated.

On the other side, sizes of recording material (recording paper) application for use in a photocopier and a printer normally exist in plurality. Especially, in case of bringing a toner image formed on a small-sized recording material into heat fixing, the above described temperature rise in non-paper feeding portion might take place. Excess temperature rise is not preferable since it will result in decreasing endurance property of a heat fixing apparatus, and in case of bringing large-sized paper into fixing in succession to the fixing step on small-sized paper, will result as well in image defects with the toner images ending in hot offset and the like.

Therefore, a heat fixing apparatus in which heat dissipation distribution of a ceramic heater can be changed in accordance with size of recording material has been disclosed in Japanese Patent Application Laid-Open No. H10-177319. The ceramic heater mounted on this heat fixing apparatus has on a ceramic substrate a first heat generating resistor with resistance value in the center in longitudinal direction being larger than those in the both ends thereof and a second heat generating resistor with resistance value in the both ends being larger than in the center, and electrical power supply to these two heat generating resistors are made individually controllable. In this case, the center in longitudinal direction is the conveyance reference of recording material where recording material in all sizes passes. Setting various electrical power supply ratio to the first heat generating resistor and the second heat generating resistor enables setting of various kinds of heat dissipation distributions of the ceramic heater.

Use of the above described safety element can be considered as safety measurements on the ceramic heater having a plurality of heat generating resistors with different heat dissipation distributions. In addition, also in this heater, in order to prevent the safety element from mal-operation due to temperature rise in non-paper feeding portion as described above, it can be considered that the safety element is disposed within a region where a small-sized recording material passes, that is, a region of the first heat generating resistor where the heat dissipation amount is large.

In assumption of such a runaway pattern on the heat generating resistors in the heat fixing apparatus, firstly, in case of the both of two heat generating resistors having run away, naturally, the safety element will operate quickly to enable prevention of abnormal temperature rise. Next, in the case where only the first heat generating resistor has run away, since the safety element is disposed in the region of the first heat generating resistor where the heat dissipation amount is large, likewise the safety element will operate quickly to enable prevention of abnormal temperature rise.

However, in the case where only the second heat generating resistor has run away, since the safety element is disposed indeed in the region of the first heat generating resistor where the heat dissipation amount is large, but in the region of the second heat generating resistor where the heat dissipation amount is small, it can be considered that responsiveness of the safety element gets bad.

SUMMARY OF THE INVENTION

The present invention was implemented in view of the above described problems, and the object thereof is to provide an image heating apparatus that can cut off electrical power supply quickly when a heater has run away and to provide an image heating apparatus and a heater to be used in the apparatus.

Another object of the present invention is to provide an image heating apparatus which is equipped with a heater having a plurality of heat generating resistors with different heat dissipation distributions and, nevertheless, is excellent in responsiveness of an safety element.

Still another object of the present invention is to provide an image heating apparatus with an safety element which quickly operates even in case of only a heat generating resistor with a small heat dissipation amount in the vicinity of the recording material conveyance reference having gone into runaway and to provide a heater to be used in this apparatus.

Still another object of the present invention is to provide an image heating apparatus, comprising a heater having a substrate and first and second heat generating resistors formed on said substrate, most of the region of said first heat generating resistor having smaller resistance value per unit length toward an end in the longitudinal direction of said substrate, and most of the region of said second heat generating resistor having larger resistance value per unit length toward the end, wherein an electrical power supply to said first heat generating resistor and an electrical power supply to said second heat generating resistor are individually controllable; and a safety element which operates in response to the heat of said heater to cut off electrical power supply to said first and second heat generating resistors, wherein only said second heat generating resistor in said first and second heat generating resistors has a high resistance part corresponding to said safety element in a part in the longitudinal direction thereof.

Still another object of the present invention is to provide a heater comprising:

a substrate; and first and second heat generating resistors formed on said substrate;

wherein most of the region of said first heat generating resistor having smaller resistance value per unit length toward an end in the longitudinal direction of said substrate, and most of the region of said second heat generating resistor having larger resistance value per unit length toward the end; and wherein only said second heat generating resistor in said first and second heat generating resistors has a high resistance parthigh resistance part corresponding to a safety element in a part in the longitudinal direction thereof.

Still another object of the present invention is to provide an image heating apparatus, comprising a heater having a substrate and first and second heat generating resistors formed on said substrate, most of the region of said first heat generating resistor having smaller resistance value per unit length toward an end in the longitudinal direction of said substrate, most of the region of said second heat generating resistor having larger resistance value per unit length toward the end, wherein electrical power supply to said first heat generating resistor and electrical power supply to said second heat generating resistor are individually controllable; and a safety element which operates in response to the heat of said heater to cut off electrical power supply to said first and second heat generating resistors, wherein the both of said first and second heat generating resistors have high resistance part corresponding to said safety element in parts in the longitudinal direction thereof and a resistance value increase percentage of the high resistance part of said second heat generating resistor is larger than that of the high resistance part of said first heat generating resistor.

Still another object of the present invention is to provide a heater comprising:

a substrate; and first and second heat generating resistors formed on said substrate;

wherein most of the region of said first heat generating resistor having smaller resistance value per unit length toward an end in the longitudinal direction of said substrate, and most of the region of said second heat generating resistor having larger resistance value per unit length toward the end; and wherein the both of said first and second heat generating resistors have high resistance part corresponding to a safety element in parts in the longitudinal direction thereof and a resistance value increase percentage of the high resistance part of said second heat generating resistor is larger than that of the high resistance part of said first heat generating resistor.

Further objects of the present invention will become obvious in view of the following detailed description with reference to the attached drawings.

DETAILED DESCRIPTION OF THE PREFERRED EMBODIMENTS

First Embodiment

The first embodiment of the present invention will be described as follows.

(1) Embodiment in Image Forming Apparatus

Figure 1:
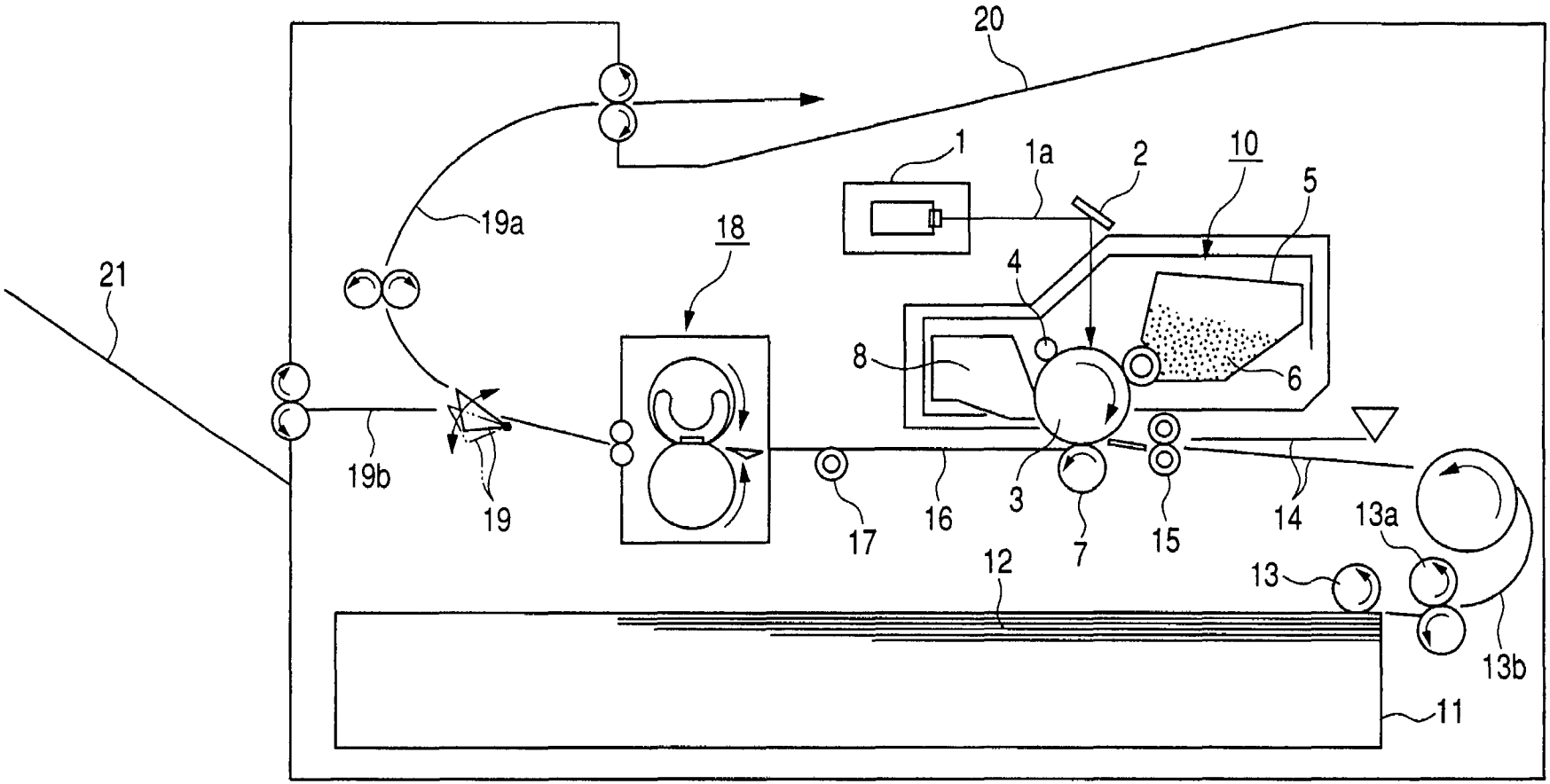
FIG. 1 shows a diagram of an example of an image forming apparatus.

FIG. 1 is a sectional diagram showing schematic configuration of an image forming apparatus in which an image heating apparatus of the present invention has been installed. Reference numeral 1 denotes a scanner unit, having a semiconductor laser emitting laser beams corresponding with image information, a polygon mirror to deflect laser beams emitted from the semiconductor laser, a lens to make the laser beam deflected with the polygon mirror form an image on a photosensitive drum 3 and the like. Reference numeral 1*a* denotes a laser beam emitted from the scanner unit 1. Reference numeral 10 denotes a process cartridge with a principal image forming means built-in, configured by comprising a photosensitive drum (electrophotographic photosensitive member) 3 being a latent image holding member, a roller charger 4 made of semiconductive rubber, a developing apparatus 5 to supply toner 6 onto the photosensitive drum 3 and a cleaner 8 to remove residual toner from the surface of the photosensitive drum 3. The photosensitive drum 3 in this process cartridge 10 is rotating clockwise in the direction indicated by an arrow and is charged evenly on its surface by the roller charger 4. Onto the evenly charged surface of the photosensitive drum 3, the laser beam 1*a* emitted from the scanner unit 1 is irradiated via the mirror 2 and thereby an electrostatic latent image is arranged to be formed on the surface of the photosensitive drum 3. In addition, the developing apparatus 5 supplies toner to this electrostatic latent image, which is visualized as a toner image.

On the other hand, recording material in a sheet feeding cassette 11 is separated sheet by sheet and sheet-fed with a sheet feeding roller 13 and a pair of separating rollers 13*a*. The sheet-fed recording material 12 is reversed with a U-turn sheet path 13*b* and conveyed to a pair of registration rollers 15 along a top and a bottom guides 14. Until the recording material 12 arrives, the registration rollers 15 refrain from rotating and make the tip of the recording material 12 thrust to their nip to receive the recording material 12 and thereby correct its skewing.

Next, the registration rollers 15 convey the recording material 12 to a transfer unit being the nip to contact the photosensitive drum 3 and a transfer roller 7 so as to synchronize with the tip of an image formed on the above described photosensitive drum 3. Here, in the vicinity of this registration roller 15 a sheet feeding sensor (not shown) is equipped and detects the state of sheet feeding or jamming and length of recording material.

The recording material 12 conveyed to the transfer unit as described above is counter-charged against the toner by the transfer roller 7 from the reverse side and the toner image formed on the above described photosensitive drum 3 is transferred onto the recording material 12.

The recording material 12 with the toner image transferred is conveyed to a fixing apparatus (image heating apparatus) 18 with a conveying guide 16 as well as with a conveying roller 17. The fixing apparatus 18 brings not-yet fixed toner image into fixing onto the recording material 12 with heat and pressure.

In the case where discharge of downward directing mode from the image face is designated, the recording material 12 subject to image fixing is guided to the side of the U-turn sheet path 19*a* by a flapper 19 and is discharged onto a first sheet discharge tray 20. In addition, in the case where discharge of upward directing mode from the image face is designated, it is guided to the side of the straight-forwarding sheet path 19*b* by the flapper 19 and is discharged onto a second sheet discharge tray 21.

Here, for the image forming apparatus of the present embodiment, the conveyance reference of the recording material 12 is the center line going in the center of the width direction of a paper (the direction perpendicular to the conveyance direction) throughout the conveyance path.

(2) Fixing Apparatus (Image Heating Apparatus) 18

Figure 2:
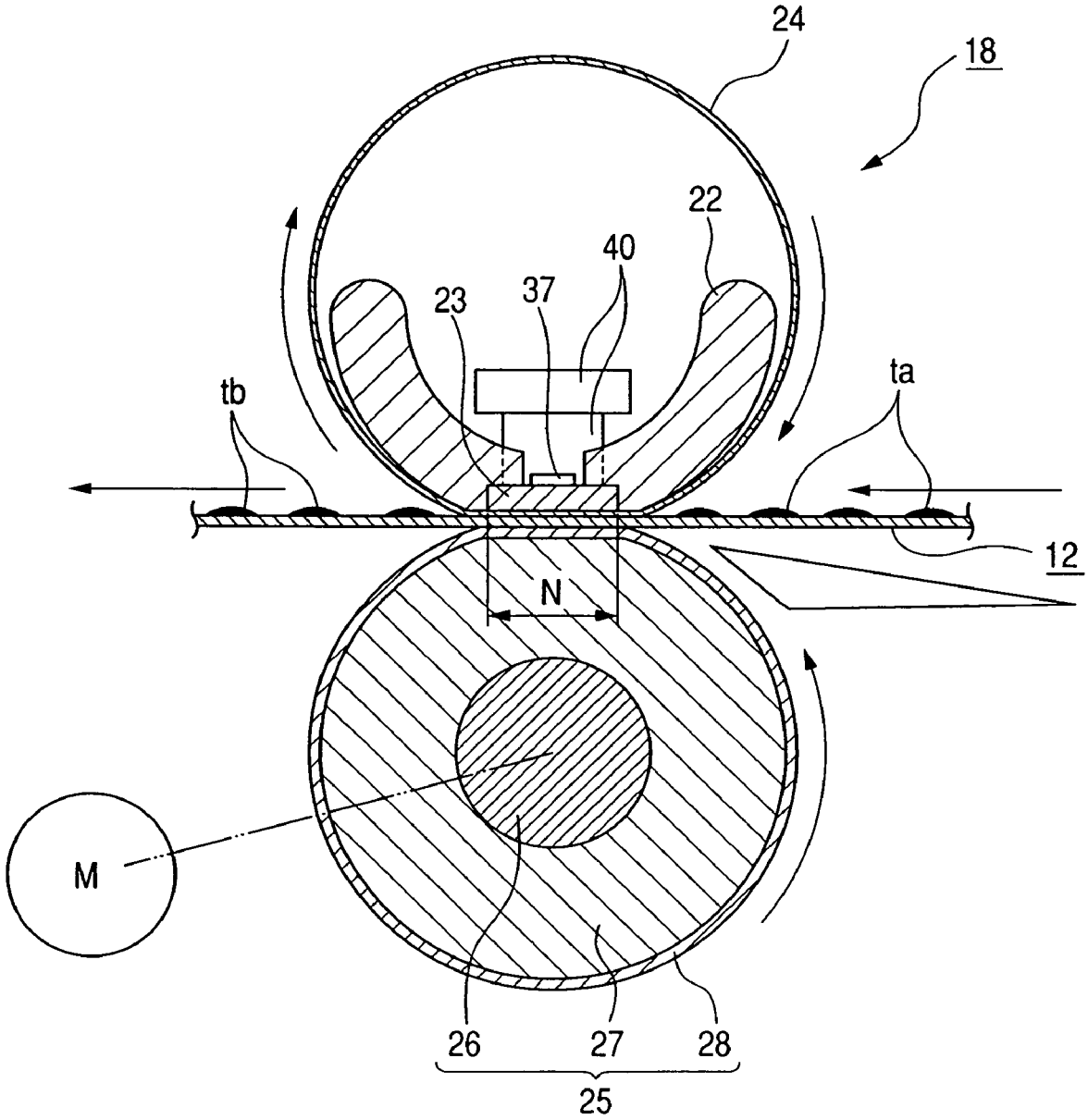
FIG. 2 shows a model sectional side diagram of a fixing apparatus.

Next, the fixing apparatus 18 will be described in detail based on FIG. 2. The fixing apparatus 18 of the present embodiment is a heating apparatus of a film heating system of a pressure roller drive system/a tensionless type. In addition, it is an apparatus with the conveyance reference of recording material being the center line.

The heater mounted on the fixing apparatus of the present embodiment, details of which will be described later, has a substrate, a main as well as sub heat generating resistor formed on the substrate and most region of the main heat generating resistor has resistance value per unit length getting smaller and smaller toward the end in the longitudinal direction of the substrate while most region of the sub heat generating resistor has resistance value per unit length getting larger and larger toward the end. In addition, electrical power supply to the main heat generating resistor and electrical power supply to the sub heat generating resistor are individually controllable. In addition, of the main and the sub heat generating resistors, only the sub heat generating resistor has a high resistance part corresponding with a safety element in a part of its longitudinal direction. This configuration is to ensure responsiveness of the safety element even in the case where only the sub heat generating resistor has run away.

Moreover, the high resistance part of the sub heat generating resistor is disposed in the same place in the substrate longitudinal direction as the region with the largest resistance of the main heat generating resistor. This configuration is to deprive heat shortage in the safety element disposition region even in case of heating only the main heat generating resistor as in the time when a small-sized sheet is brought into fixing.

a) Holistic Schematic Configuration of Apparatus 18

Reference numeral 22 denotes a heat-resisting stay holder as heat member supporting unit and a heat-resisting member shaped as a gutter of an approximately semicircle in side sectional view. A heating member (hereinafter referred to as heater) 23 is brought into engagement with the groove provided along the holder in the longitudinal direction on the bottom surface of the stay holder 22 for fixing for supporting. The configuration of this heater 23 will be described in detail in the next section (b).

Reference numeral 24 denotes a cylindrical thin film (hereinafter referred to as fixing film) made of such as polyimide having excellent heat resistance as a flexible sleeve and is brought into loose engagement externally with the stay holder 22 to which the above described heater 23 is fixed for supporting. The heater 23 is in contact with the inner surface of the fixing film 24. Reference numeral 25 denotes a pressure roller having elastic layer.

Pressure is applied to the gap between the heater 23 and the pressure roller 25 to sandwich the fixing film 24 and make the heater 23 on the bottom surface of the stay holder 22 and the elastic pressure roller 25 as a pressure member form a fixing nip N with a predetermined width required for heat fixing.

As for the pressure roller 25, the elastic layer 27 made of silicon rubber and the like is formed in the outskirt of the core metal 26, and moreover, the further outskirt thereof is covered with a tube made of PFA and PTFE, etc. having excellent mold-releasing property being a mold-releasing layer 28. Heat conductivity of the pressure roller 25 is $0.5\times10^{3}$ W/° C.·cm.

The pressure roller 25 is driven to rotate counter-clockwise as directed by an arrow with a driving means M (pressure roller drive system). In addition, a contact friction force driven by rotation of the pressure roller 25 in the fixing nip N between the roller 25 and the outskirt surface of the fixing film 24 operates as a rotation force to the cylindrical fixing film 24 so that the fixing film 24 rotates counterwise as directed by an arrow around the stay holder 22 with the inner surface of the film sliding in tight contact with the downward surface of the heater 23 in the fixing nip N.

Under such a state that the fixing film 24 is brought into rotation driven by rotation of the pressure roller 25 and the heater 23 has been heated to keep under temperature control at a predetermined target temperature with power distribution to the heater 23 as described later, the recording material 12 as material to be heated carrying not-yet fixed toner image ta is introduced into the fixing nip N between the fixing film 24 and the pressure roller 25 so that the toner image carrying face passes the fixing nip N together with the fixing film in tight contact with the outskirt surface of the fixing film 24, and thereby the heat of the heater 23 is given to the recording material 12 through the fixing film 24 and the not-yet fixed toner image ta is brought into heat fixing tb onto the surface of the recording material 12. The recording material 12 having passed through the fixing nip N is separated from the face of the fixing film 24 by curvature to be conveyed for discharge.

The stay holder 22 functions as a supporting member for the heater 23 and also acts to ensure the pressure to the fixing nip N and rotation conveyance stability of the cylindrical fixing film 24.

The inner surface of the fixing film 24 slides for rotation on the bottom surface of the heater 23 in the fixing nip N and on the outskirt surface of the stay holder 22 in the vicinity of the fixing nip N. In order to bring the fixing film 24 into smooth rotation with a low torque, friction resistance between the heater 23 as well as the stay holder 22 and the fixing film 24 is required to be made small. For the purpose hereof, a small amount of a lubricant agent such as heat-resisting grease and the like is placed intermediate to the gap between the heater 23 as well as the stay holder 22 and the fixing film 24. This will enable the fixing film 24 to rotate smoothly.

The fixing film 24 as a flexible sleeve is a member with small heat capacity and is a film made of material selected from a group consisting of polyimide, polyamide-imide, PEEK, PES, PPS, PFA, PTFE, FEP and the like having thickness not more than 100 μm to enable a quick start and being heat resistant and heat flexible. In addition, as a film having sufficient strength for configuring a fixing apparatus for a long life and being excellent in endurance, thickness of not less than 20 μm is required. Accordingly, as thickness of the fixing film 24, not less than 20 μm and not more than 100 μm is optimum. Moreover, in order to ensure prevention against offset and separation property of the recording material, the surface layer of the fixing film may be covered by mixture of heat-resisting resin with excellent mold-releasing property such as PFA, PTFE, FEP and silicon resin and the like or individually.

Various kinds of image forming apparatuses such as printers, photocopiers and the like with a fixing apparatus in such a film heating system retain quite a few advantages compared with the system to implement heat fixing with a conventional heat roller and the like, eliminating necessity of standby preheating, shortening waiting time and the like with high heating efficiency and quick rising.

b) Heater 23

Figure 3A:
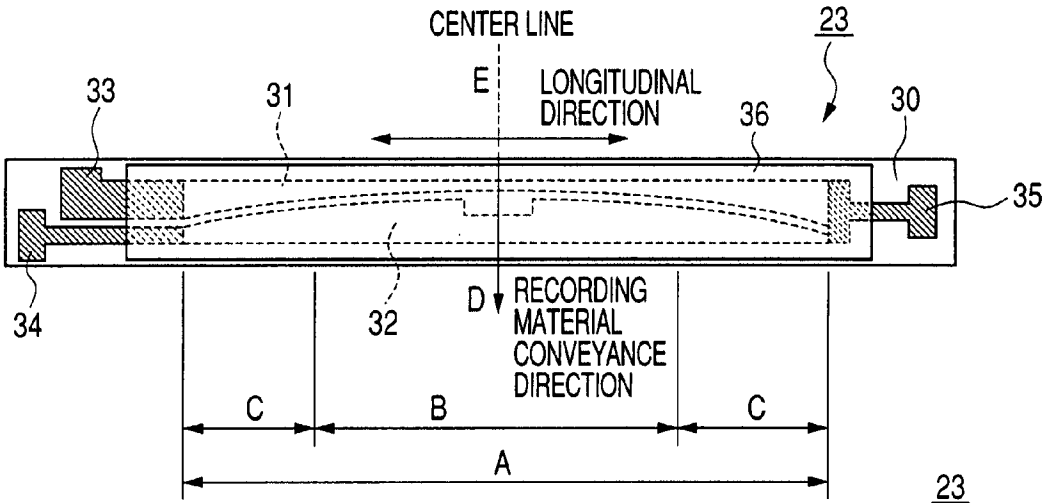
FIGS. 3A, 3B and 3C show a configuration explaining diagram of a heater.
Figure 3B:
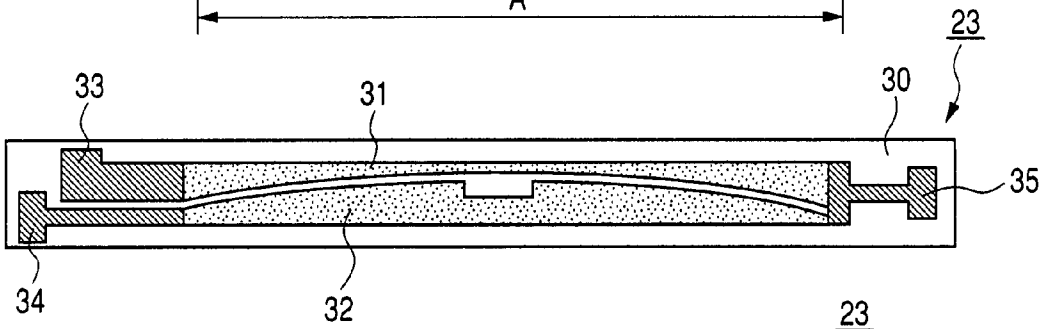
Figure 3C:
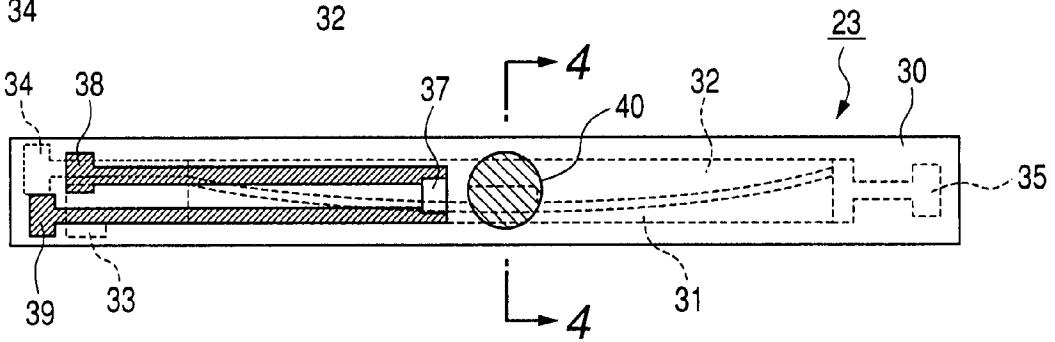
Figure 4:
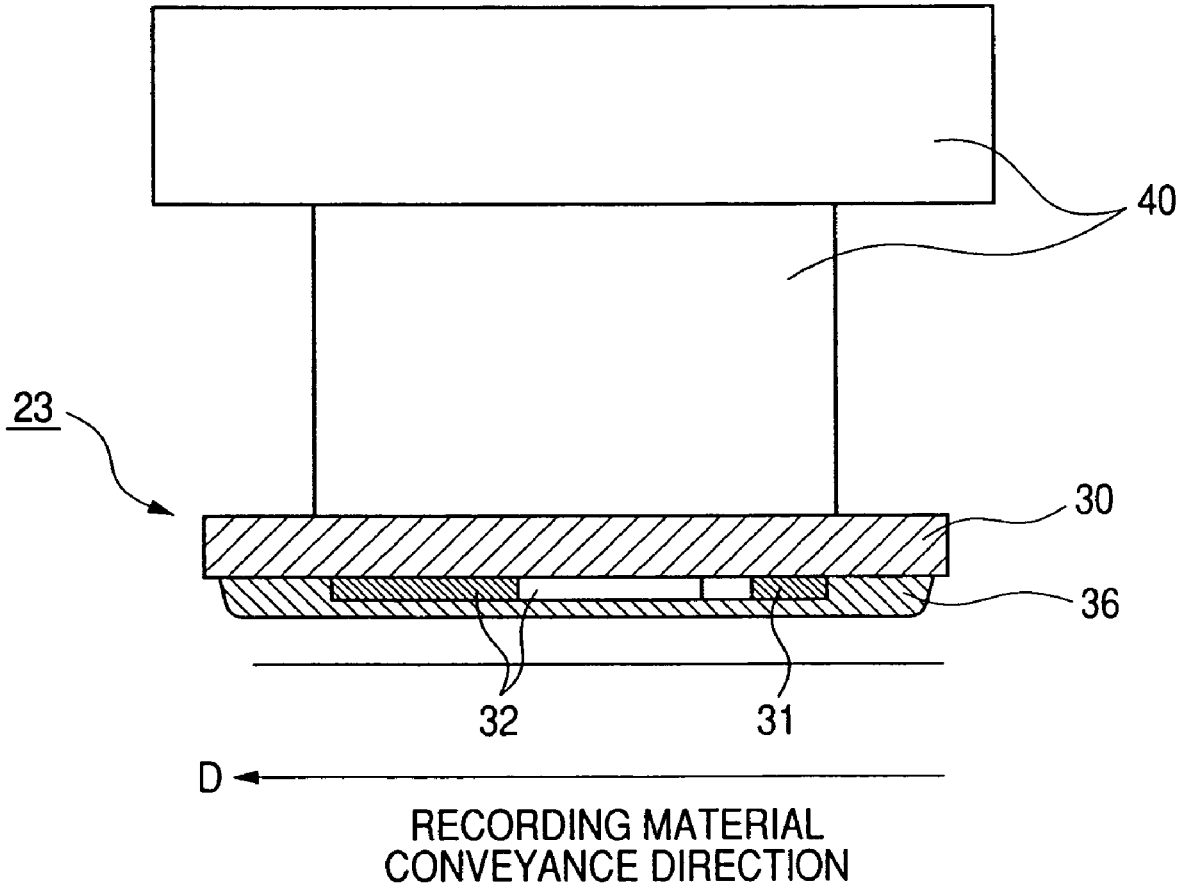
FIG. 4 shows an enlarged model sectional side diagram of the heater.
Figure 5:
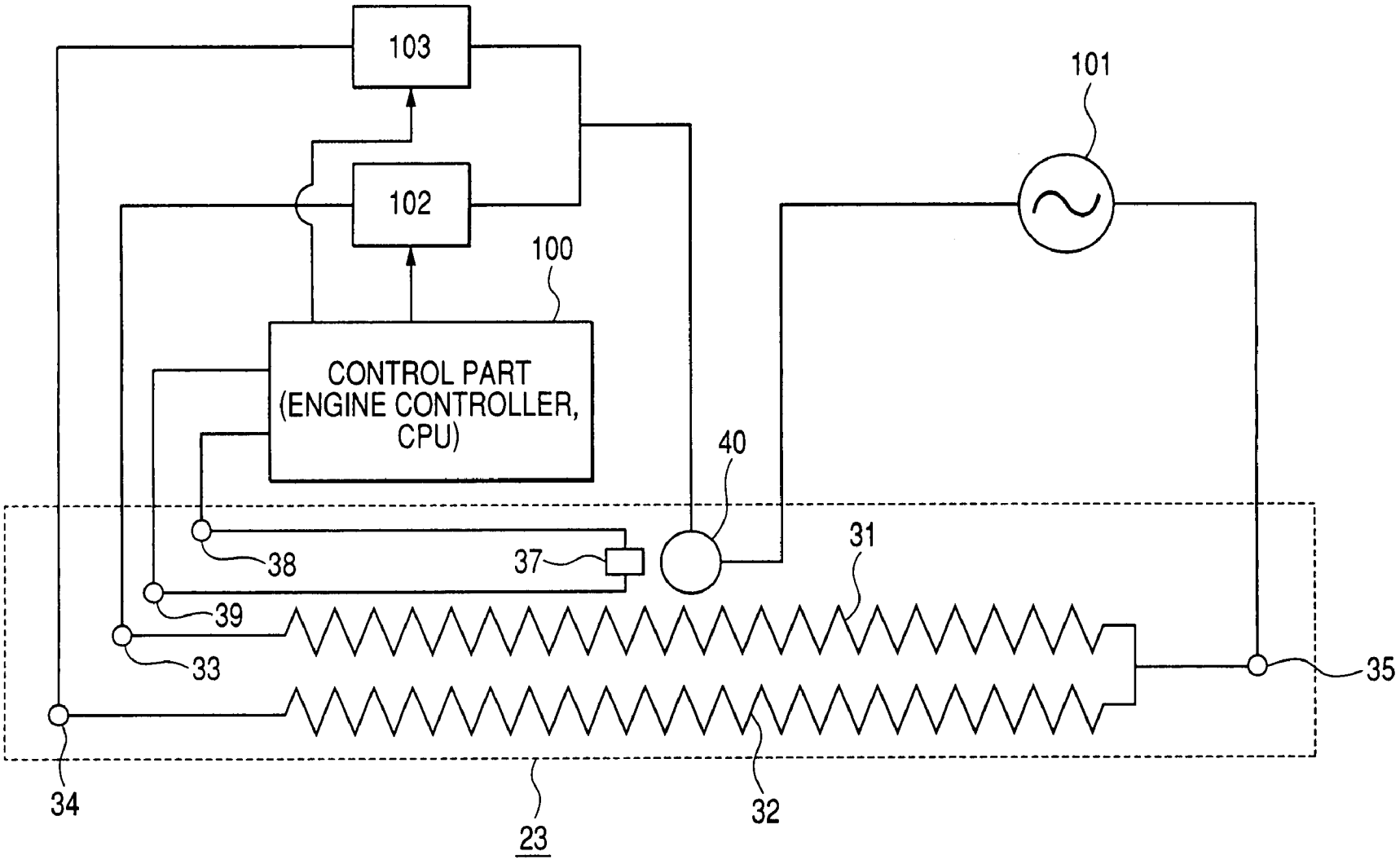
FIG. 5 shows a block diagram of a power dispatching control system of a heater.
Figure 6:
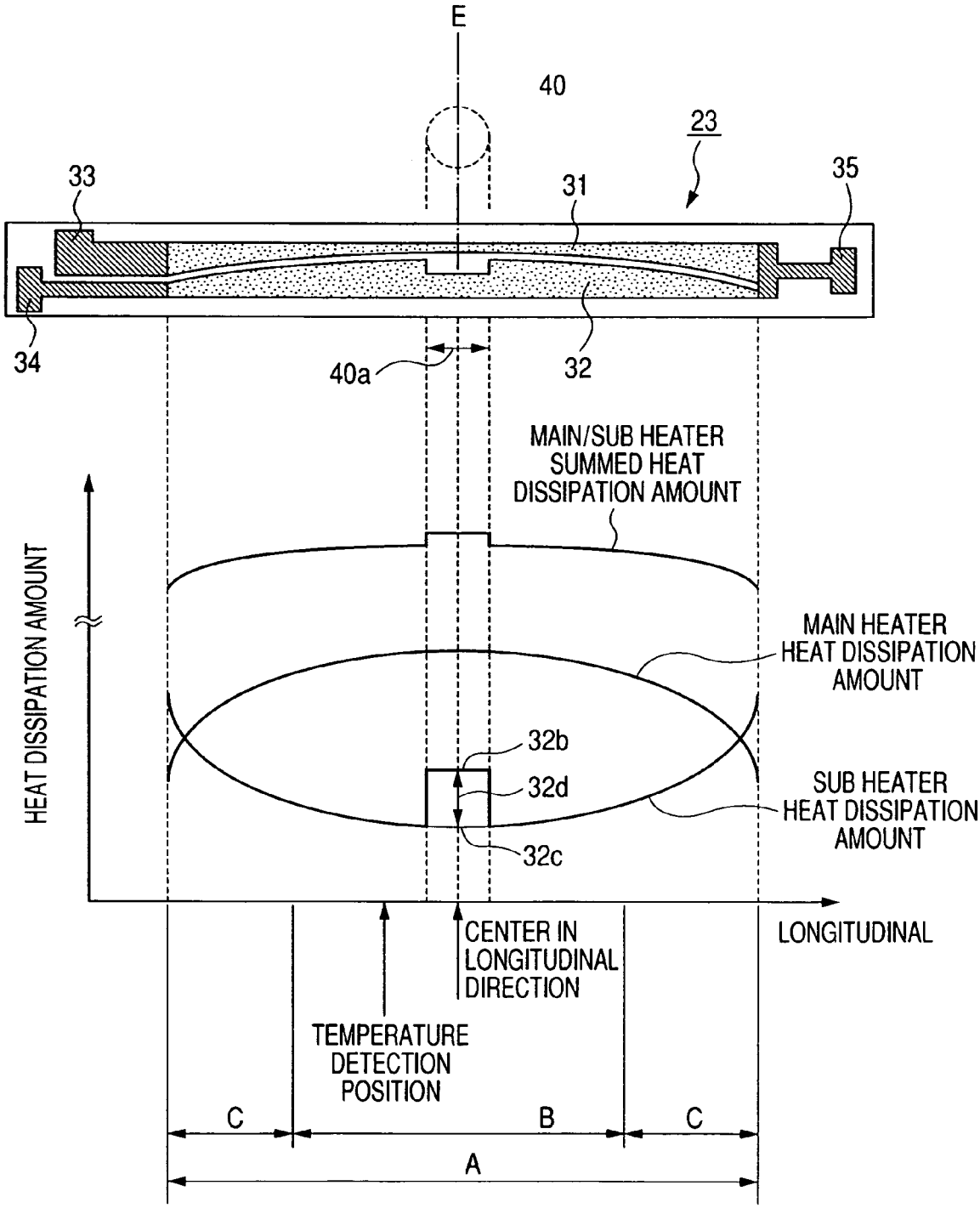
FIG. 6 shows an explanatory diagram of a pattern shape and heat distribution of a heat generating resistor of a heater in Embodiment 1.

FIG. 3A is a plan schematic diagram of the front surface side of the heater, FIG. 3B is a plan schematic diagram of the front surface side of the heater subject to removal of the surface protection layer and FIG. 3C is a plan schematic diagram of the back surface side of the heater. FIG. 4 is an enlarged cross-sectional diagram cut away along the line 4—4 in FIG. 3C. FIG. 5 is a diagram of a power dispatching circuit (AC circuit) as well as a control circuit (DC circuit) for the heater 23. FIG. 6 is a diagram showing heat dissipation distribution respectively on the main heater and the sub heater as well as summed heat dissipation distribution on the both units.

Reference numeral 30 denotes a heater substrate. This heater substrate 30 is heat-resisting, well heat conducting and electro-insulating ceramic material made of almina and aluminium nitride, etc., being a longitudinal film member with the longitudinal direction brought into intersection (orthogonal intersection) against the recording material conveyance direction D.

Reference numerals 31 and 32 denote two pieces of a first and a second heat generating resistor (hereinafter referred to as main heater and sub heater) formed and comprised as a heat generator generating heat with power distribution by thick film printing on the front surface side of the heater substrate 30.

These main heater 31 and sub heater 32 are respectively formed along the heater substrate longitudinal direction and are arranged in the recording material conveyance direction. In addition, the main heater 31 and the sub heater 32 are different each other with respect to heat dissipation distribution in the respective longitudinal directions. In particular, with respect to a region other than a part of region of heat generating resistor corresponding to the later described safety element installation site (an area 40*a* in FIG. 6), that is, with respect to the most of the region of the heat generating resistor, the main heater 31 has a resistor pattern with heat dissipation distribution decreasing heat dissipation amount from the center to the end thereof in its longitudinal direction, while the sub heater 32 has a resistor pattern with heat dissipation distribution increasing heat dissipation amount from the center to the end thereof in its longitudinal direction. In other words, for the most part of the main heater (the first heat generating resistor), the resistor value per unit length gets smaller as approaching the both ends in the longitudinal direction of the substrate while for the most part of the sub heater (the second heat generating resistor), the resistor value per unit length gets larger as approaching the both ends in the longitudinal direction of the substrate. In addition, in a region other than a part of region of heat generating resistor corresponding to the safety element installation site, that is, in the most of the region of the heat generating resistor, the summed heat dissipation amount (summed resistance value) of the heat dissipation amount (resistance value) of the main heater 31 and the heat dissipation amount (resistance value) of the sub heater 32 is approximately even along the longitudinal direction of the heat generating resistor. In addition, with respect to the sub heater 32, the heat dissipation amount (resistance value) in the region corresponding to the safety element installation site, is not maximum in the heat generating resistor longitudinal direction but the heat dissipation amount (resistance value) in the both end regions is maximum. In addition, in the present embodiment, the region with high heat dissipation amount (high resistance part) compensating heat transfer to the safety element is provided only to the sub heater 32 (a squeezed portion disposed in the center line position in FIGS. 3A to 3C) while the main heater 31 is not provided with such a region with high heat dissipation amount. In addition, the high resistance part of the sub heater is provided to the same position in the substrate longitudinal direction as the region with highest heat dissipation amount (resistance value) of the main heater and this position is the position of conveyance center (the center line E in FIG. 3A) of the recording material as well.

Reference numeral 33 denotes an electrode for power dispatching (hereinafter referred to as main contact point) formed in an end of the main heater 31 in the longitudinal direction, reference numeral 34 denotes an electrode for power dispatching (hereinafter referred to as sub contact point) formed in an end of the sub heater 32 in the longitudinal direction and reference numeral 35 denotes a common electrode for power dispatching (hereinafter referred to as common contact point) formed in the other end of the main heater 31 and the sub heater 32 in the longitudinal direction.

The above described main contact point 33, sub contact point 34 and common contact point 35 are all formed as a conductor pattern by thick film printing on the front surface in the both end sides of the heater substrate.

Reference numeral 36 denotes a surface protection layer, which is made to cover the main heater 31, the sub heater 32, a part of the main contact point 33, a part of the sub contact point 34 and a part of the common contact point 35 and is formed on the front surface of the heater substrate 30. This surface protection layer 36 is formed as a glass coat pattern by thick film printing. The inner face of the fixing film 24 slides in tight contact with the front surface of this surface protection layer 36.

Reference numeral 37 denotes temperature detecting means (temperature detecting element) such as thermistor and the like. In the present embodiment, a thermistor is used and disposed so as to contact the rear surface side of the heater substrate 30 in the position corresponding to a place in the paper feeding region with of recording material with the minimum size and a position apart from the highest resistance value region (the position of the conveyance center E in the present embodiment) of the main heater 31.

Reference numerals 38 and 39 denote leads (hereinafter referred to as thermistor contact point) made to provide electric continuity with the thermistor 37. These thermistor contact points 38 and 39 are formed as conductor patterns by thick film printing on the rear surfaces of the heater substrate.

Reference numeral 40 denotes a safety element such as a thermoswitch and a thermofuse, etc. In the present embodiment, a thermoswitch is used. This thermoswitch 40 is disposed so as to contact the rear surface side of the heater substrate 30 in the position approximately corresponding to the center line E being recording material conveyance center (=the center in the longitudinal direction in the heat generating region of the heater 23). In addition, this safety element is brought into electric contact between the power supply and the main heater as well as the sub heater.

In FIG. 3A, reference character A denotes the maximum paper feeding region width. The lengths in the longitudinal direction of the main heater 31 and the sub heater 32 are approximately corresponding to this maximum paper feeding region width A. Reference character B denotes the paper feeding region width of recording material with the minimum size. Reference characters C and C denote non-paper feeding region width ((A−B)/2) at the time of paper feeding with the recording material with the minimum size.

FIG. 5 is a diagram of a power dispatching circuit (AC circuit) as well as a control circuit (DC circuit) for the heater 23. Reference numeral 100 denotes a control part (an engine controller, CPU). Reference numeral 101 denotes an AC power supply. Reference numerals 102 and 103 are respectively a first and a second triacs. In addition, the following two systems of a and b power dispatching routes (AC lines) are configured, namely:

a: AC power supply 101→thermoswitch 40→first triac 102→main contact point 33→main heater 31→common contact point 35→AC power supply 101 b: AC power supply 101→thermoswitch 40→second triac 103→sub contact point 34→sub heater 32→common contact point 35→AC power supply 101.

In addition, the control part 100 controls the first and the second triacs 102 and 103 to control power supply to the main heater 31 and the sub heater 32.

In addition, to the control part 100, the temperature information of the heater 32 which the thermistor 37 detects is fed back through the thermistor contact points 38 and 39 as digital signals (DC line).

The control part 100 controls the first and the second triacs 102 and 103 based on the heater temperature detection information fed back from the thermistor 37 to control power supply to the main heater 31 and the sub heater 32 so that the heater temperature is maintained at a predetermined target temperature. In addition, it controls the first and the second triacs 102 and 103 based on the size information on the recording material 12 brought into paper feeding to control the power supply ratio to the main heater 31 and the sub heater 32.

The thermoswitch 40 as safety element acts to urgently cut off electrical power supply to the heater 23 in response to temperature overrising of the heater 23 even if malfunction in the control part 100 and the like brings about such an event (thermal runaway) which might implement electrical power supply in an uncontrolled and continuous fashion.

FIG. 6 shows heat dissipation distribution in the longitudinal direction of the main heater 31, heat dissipation distribution in the longitudinal direction of the sub heater 32 and summed heat dissipation distribution of the both parties. Both of heat dissipation distribution of the main heater 31 and the sub heater 32 are brought into continuous change from the center to the both ends. The main heater 31 is shaped to form a pattern so as to make the heat dissipation amount large in the center while the sub heater 32 to make the heat dissipation amount large in the both ends.

When a large sized paper is brought into fixing, the electrical power supply ratios to the main heater and to the sub heater are made approximately even. In addition, when a small sized paper is brought into fixing, bringing only the main heater 31 into electrical power supply, or putting mainly the main heater 31 on, or equalizing the number of sheet of paper feeding within a predetermined period as in case of fixing on a large sized paper, or slightly reducing the number, non-paper feeding region temperature rise can be controlled and changes in shape of the pressure roller due to non-paper feeding region temperature rise can be controlled. This enables to prevent wrinkles and glossy uneveness due to pressure roller shape. In addition, deterioration in endurance of a heat fixing apparatus can be controlled and in the case where a large sized paper is brought into fixing, the toner image can be prevented from ending in hot offset.

In the present embodiment, the thermoswitch 40 is used as the electric safety element of the heater 23. This thermoswitch 40 is disposed in the same position as the highest resistance value region of the main heater in the longitudinal direction or the center of the heat generating resistor in the longitudinal direction in this embodiment and the position being the conveyance reference E of the recording material in case of the present embodiment. Use of a contact type safety element gives rise to uneven heating and response time lag due to heat capacity of the safety element. In order to prevent this harmful effect, it is necessary to make the heat dissipation amount larger in the heater part corresponding to the contact point part.

Under the circumstances, making heat generating resistor value larger (providing high resistor part) in the region corresponding to the safety element contact point, heat deprived by the safety element is compensated. In this embodiment, this high resistor part is not provided to the main heater (first heat generating resistor) but provided only to the sub heater (second heat generating resistor). Providing only the sub heater with the high resistor part like this, heat quantity transferred to the element will increase so as to enable the safety element to operate quickly when only the sub heater has run away. In addition, in the case where the both of the main heater and the sub heater have run away, since heat quantity transferred to the safety element is sufficient, the safety element operates quickly. Also in the case where only the main heater has run away, since heat quantity transferred to the safety element is sufficient, the safety element operates quickly.

Incidentally, as having been described above, in the case where a large-sized paper (with the width A in FIG. 6) is brought into fixing, the electrical power supply ratio to the main heater and the sub heater is approximately even, and in the case where a small-sized paper (with the width B in FIG. 6) is brought into fixing, electrical power supply take place only to the main heater 31, or the electrical power supply ratio to the main heater 31 is made higher that that to the sub heater. In case of the present embodiment, when a large-sized paper is brought into fixing, electrical power supply takes place at the electrical power supply ratio to the main heater and to the sub heater of 100:100. In case of the present embodiment, when a small-sized paper is brought into fixing, electrical power supply takes place at the electrical power supply ratio to the main heater and to the sub heater of 100:0.

In the case where a large-sized paper is brought into fixing, since both of the two resistors generate heat, increase in heat quantity by the high resistor part provided in the sub heater can compensate heat transfer to the safety element.

On the other hand, in the case where a small-sized paper is brought into fixing, only the main heater lacking the high resistor part for compensating heat transfer to the safety element generates heat, or the both of the main heater and the sub heater generate heat but mainly the main heater is made to generate heat. Accordingly, it is considered that heat transfer to the safety element cannot be compensated.

However, in the present embodiment, the thermoswitch 40 is disposed in the highest resistance value region of the main heater (the region with the largest heat quantity), or in the present embodiment, the center in the longitudinal direction in the heat generating region of the heater 23. The heat dissipation amount of the main heater 31 in this position is originally sufficiently large even in case of lacking high resistor part for compensating heat transfer to the safety element, and since percentage of the quantity of heat transfer toward the safety element to the heat dissipation amount is small, even if heat transfer to the safety element occurs, temperature will not decrease enough to cause defects in fixing. Accordingly, disposing the safety element in the heat generating peak point of the main heater, occurrence of insufficiency in heating of the toner image can be eliminated without providing the main heater with a high resistor part for compensating heat transfer to the safety element. On the contrary, since the sub heater 32 with heat generating peak located in the both end parts are significantly affected by heat transfer to the thermoswitch 33, the heat dissipation amount of the thermoswitch installation part 40*a* is set at the heat dissipation amount 32*b* (=32*c*+32*d*) larger than the original heat dissipation amount 32*c*. However, making the heat dissipation amount 32*b* of the thermoswitch installation part 40*a* too large with respect to the sub heater 32 gives rise to image defects or hot offset due to getting hot.

Therefore, the heat dissipation increased amount (heat dissipation amount increased percentage=resistance value increased percentage) in the thermoswitch installation part 40*a* with respect to the main heater 31 and the sub heater 32 is defined as follows.

Increased portion A of heat dissipation amount of main heater 31 A=0 (no increased portion in the present embodiment)

Increased portion B of heat dissipation amount of sub heater 32 B=32*d*/32*c*

Here, six kinds of heaters with different values of increased portion (percentage of increase) B of heat dissipation amount of sub heater 32 were respectively set in a fixing apparatus to research their relationship on the safety circuit operation performance, the fixing property and hot offset. Results thereof will be indicated in the following Table 1. Here, among these assessments, an item on safety circuit operation was measured on whether or not the thermoswitch operated within a stipulated period with only the sub heater brought into heat generating at electrical power supply ratio of 100% without paper feeding to the fixing nip (without temperature control by the thermistor 37). The item on fixing property relates to the case where papers with maximum size (width A in FIG. 6) were brought into continuous fixing and papers with minimum size (width B in FIG. 6) were brought into continuous fixing, while electrical power supply to the main heater and to the sub heater was controlled so that the detected temperature of the thermistor 37 is maintained at the target temperature to provide satisfactory fixing property of the toner. As having been described above, the electrical power supply ratio to the main heater and to the sub heater at the time when paper with the maximum size is brought into fixing is 100:100 while the electrical power supply ratio to the main heater and to the sub heater at the time when paper with the minimum size is brought into fixing is 100:0. And it was measured whether or not the toner is brought into fixing sufficiently. The item of hot offset relates to a research on whether or not the toner onto the fixing film 24 is set off subject to continuous fixing. Here, there are cells lacking measurement records on hot offset, and these are cells in the case where offset was not dared to be measured due to circumstances that must not give rise to hot offset.

TABLE 1

| Sub heater heat dissipation increased portion: B(%) | Operation of safety circuit | Fixing property | Hot offset |
|---|---|---|---|
| 0 | NG | NG | Not measured |
| 25 | NG | OK | OK |
| 50 | OK | OK | OK |
| 75 | OK | OK | OK |
| 90 | OK | OK | OK |
| 100 | OK | OK (however with glossy uneveness) | OK |

As shown in the item of the safety element operation in Table 1, with the value B of heat dissipation amount increased percentage (resistance value increased percentage) being not less than 50%, it is understood that the responsiveness of the thermoswitch remains in a satisfactory level even if only the sub heater 32 has run away.

In addition, as shown in the item of fixing property, with the value B being not less than 25% and not more than 90%, good fixing property can be ensured regardless paper sizes. Here, with the value B being 0% and in case of bringing paper with the minimum size into fixing, only the main heater 31 generates heat and therefore heat dissipation distribution will be as in case of "main heater heat dissipation amount" in FIG. 6, and since the thermistor 37 detects temperatures in the locations apart from the highest resistance value region (approximately the same as the area 40*a* in FIG. 6) of the main heater 31, electrical power supply control to keep the temperature in the thermistor's detection site at the target temperature will make the heat dissipation amount of the area 40*a* sufficient. However, with the value B being 0% and in case of bringing paper with the maximum size into fixing, the both of the main heater 31 and the sub heater 32 generate heat and therefore heat dissipation distribution will be as in case of "summed heat dissipation amount" in FIG. 6 and the heat dissipation amount in the detection site of the thermistor 37 will get larger than in case of "main heater heat dissipation amount". In this case, controlling electrical power supply to the main and the sub heaters to keep the temperature in the thermistor's detection site at the target temperature, electrical power supply period per unit period to the main and the sub heaters will get short than in case of main heater heat dissipation, the heat dissipation amount per unit period in the area 40*a* will get smaller than in case of "main heater heat dissipation amount". Therefore, in case of the value B being 0%, fixing property provides an NG. Since the width size of the heater substrate 30 in the direction perpendicular to the longitudinal direction is limited, it is difficult to dispose the thermoswitch 40 to coincide with the thermistor 37 in the heater substrate longitudinal direction, ending in giving rise to occurrence of NG fixing property as described above according to sizes of paper to be brought into fixing. On the contrary, when the value B reaches 100%, the heat dissipation amount in the area 40*a* rises so large to end in occurrence of image defect incurring glossy uneveness while fixing property is OK.

Here, as concerns the item of hot offset, while the value B falls within the rage of 0 to 100%, no effect enough to give rise to hot offset was seen.

Accordingly, for heat dissipation increased portion B of the sub heater 32 fulfilling these three conditions, not less than 50% and not more than 90% is appropriate. Based on this result, in the present embodiment, the heat dissipation amount increased portions A and B respectively of the main heater 31 and the sub heater 32 in the thermoswitch installation part 40*a* were determined as follows.

A=0%, B=80%

Adopting such a configuration as described above, with a heater having a first heat generating resistor (main heater 31) providing decreasing heat dissipation amount from the center to the end in its longitudinal direction and a second heat generating resistor (sub heater 32) providing increasing heat dissipation amount from the center to the end in its longitudinal direction, uneven heating and response time lag depending on heat capacity of the safety element could be prevented. Moreover, cracking in heater at the time of heat dissipation runaway due to malfunction in CPU and the like could be prevented.

As described above, the heater mounted on the fixing apparatus of the present embodiment has a substrate, a main as well as sub heat generating resistor formed on the substrate and most region of the main heat generating resistor has resistance value per unit length getting smaller and smaller toward the end in the longitudinal direction of the substrate while most region of the sub heat generating resistor has resistance value per unit length getting larger and larger toward the end. In addition, electrical power supply to the main heat generating resistor and electrical power supply to the sub heat generating resistor are individually controllable. In addition, of the main and the sub heat generating resistors, only the sub heat generating resistor has a high resistance portion corresponding with a safety element in a part of its longitudinal direction. This configuration can ensure responsiveness of the safety element even in the case where only the sub heat generating resistor has run away.

Moreover, the high resistance portion of the sub heat generating resistor is disposed in the same place in the substrate longitudinal direction as the region with the largest resistance of the main heat generating resistor. This configuration is to deprive heat shortage in the safety element disposition region even in case of heating only the main heat generating resistor as at the time when a small-sized sheet is brought into fixing.

Here, the resistor pattern of this embodiment has resistance value shifts by changing the width of the resistor in the recording material conveyance direction with a smooth curve, but the other heat generating member pattern or the other heat generating material can be used to give rise to the similar effects. That is, the resistance value may be changed by changing the width of the resistor stepwise or changing the resistor material gradually along the longitudinal direction.

Second Embodiment

Figure 7:
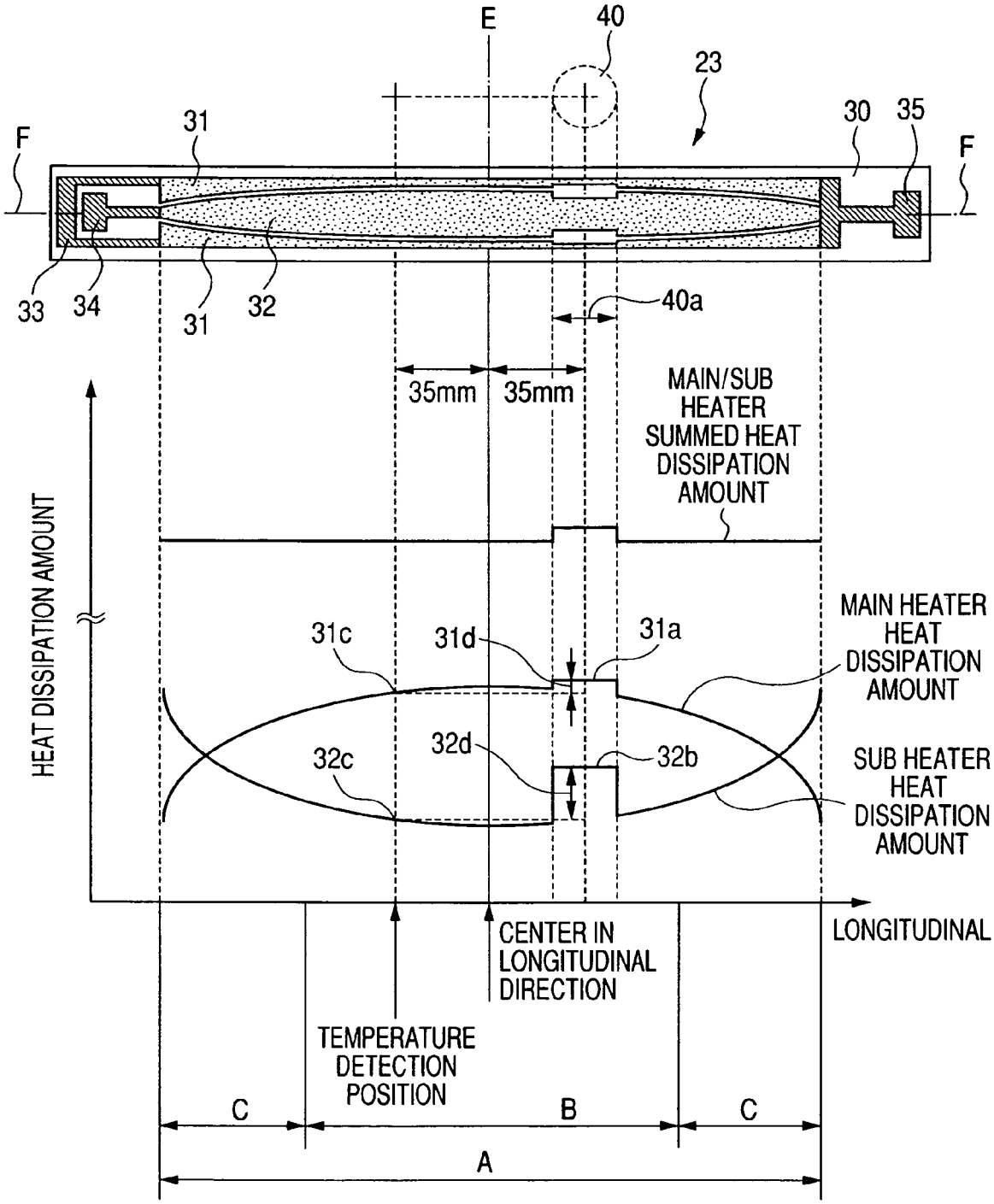
FIG. 7 shows an explanatory diagram of a pattern shape and heat distribution of a heat generating resistor of a heater in Embodiment 2.

The second embodiment of the present invention will be described as follows. The heater of the present embodiment shown in FIG. 7 has a heat generating resistor formed axisymmetric to the recording material conveyance direction center line F of a ceramic substrate. With reference to FIG. 7, three heat generating resistors are depicted, with two outside resistors (first heat generating resistor) 31 are to generate heat always simultaneously, and likewise Embodiment 1, the heater may be regarded substantially to have two kinds of heat generating resistors (the first heat generating resistor 31 and the second heat generating resistor 32). As for a fixing apparatus in which this heater is installed, the conveyance reference of the recording material is the center E. Here, in the present embodiment, the safety element 40 is brought into contact with the ceramic substrate in the location slightly apart from the region with the lowest heat dissipation amount (resistance value) of the sub heater 32 (the location of the conveyance reference E in the present embodiment). In addition, as shown in FIG. 7, the thermistor detects the heater temperature in a location approximately axisymmetric against the location where high resistance part is provided with the region provided with the lowest resistance value of the sub heater in the heater longitudinal direction (the location of the conveyance reference E in the present embodiment) being boundary.

For the image forming apparatus configuration to which the present embodiment is applied, description on the configuration of the main body and the configuration of the fixing apparatus which are similar to those in the above described embodiment 1 will be omitted.

FIG. 7 shows the heat generating resistor pattern and heat dissipation distribution of the heater in the present embodiment. The heater of the present embodiment has three heat generating resistors or heat generating resistors 31, 32 and 31 which make heat fluxes axisymmetric in the upward and downward directions to the perpendicular to the paper feeding direction. Reference character F denotes the axisymmetric axis thereof.

The two outside heat generating resistors 31 will be described as a main heater (a first heat generating resistor). The central heat generating resistors 32 will be described as a sub heater (a second heat generating resistor). The patterns of the main heater 31 and the sub heater 32 are brought 25 into continuous change from the center to the both ends in the longitudinal direction. The outside two main heaters 31 both have large heat dissipation amounts (resistance values per unit length) in the center in the longitudinal direction and are shaped axisymmetric to the substrate center F. Since the heat generating resistors are formed and shaped axisymmetric to the substrate center F, the heat dissipation distribution in recording material conveyance direction will become axisymmetric with the substrate center F as the center, giving rise to an advantage that the ceramic substrate will get strong against thermal stress. The sub heater 32 in the center provides large heat dissipation amount in the both ends in the longitudinal direction and in order to correspond with thermal stress likewise in case of the main heater 31 is shaped axisymmetric to the substrate center F. In addition, other than the heat generating resistor corresponding to the safety element installation location 40*a*, the summed heat dissipation amount (summed resistance value) of the heat dissipation amount of the main heater 31 and the heat dissipation amount of the sub heater 32 is approximately even in the longitudinal direction of the heat generating resistor. The heat dissipation amount of the heater is axisymmetric to the conveyance reference E in the longitudinal direction.

Likewise the first embodiment, when a large sized paper is brought into fixing, the electrical power supply ratios to the main heater and to the sub heater are made approximately even. In addition, when a small sized paper is brought into fixing, bringing only the main heater 31 into conduction, or putting mainly the main heater 31 on, or equalizing the number of sheet of paper feeding within a predetermined period as in case of fixing on a large sized paper, or slightly reducing the number, non-paper feeding region temperature rise can be controlled and changes in shape of the pressure roller due to non-paper feeding region temperature rise can be controlled. This enables to prevent wrinkles and glossy uneveness due to pressure roller shape. In addition, deterioration in endurance of a heat fixing apparatus can be suppressed and in the case where a large sized paper is brought into fixing, the toner image can be prevented from ending in hot offset.

In the present embodiment, the thermoswitch 40 is used as the safety element. The thermoswitch 40 is disposed in a location displaced 35 mm closer to one end in the longitudinal direction from the location approximately corresponding to the center line E being the recording material conveyance reference (=the location of the center part of the heat generating region of the heater 23 in the longitudinal direction or the approximate center part of the heater substrate in the longitudinal direction) on the rear side of the heater substrate 30. This location is within the paper feeding region of recording material with the minimum size. Use of a contact type safety element gives rise to uneven heating and response time lag due to heat capacity of the safety element. In order to prevent this harmful effect, the heat dissipation amounts 31*a* (=31*c*+31*d*) and 32*b* (=32*c*+32*d*) in the heat generating resistor portions of the main heater 31 and the sub heater 32 corresponding to the termoswitch contact location part 40*a* is made larger than the heat dissipation amounts 31*c* and 32*c* of the heat generating resistor portions located axisymmetric to the center line E (or high resistor part is provided). However, making the heat dissipation amounts 32*a* and 32*b* of the heat generating resistor portions corresponding to the thermoswitch contact location part 40*a* too large gives rise to image defects or hot offset due to getting hot. Therefore, the heat dissipation increased portion corresponding to the thermoswitch contact location part 40*a* with respect to the parts of the main heaters 31 and 31 and the part of the sub heater 32 will be described in terms percentage as follows.

Increased portion A of heat dissipation amount of main heater 31 A=31*d*/31*c*

Increased portion B of heat dissipation amount of sub heater 32 B=32*d*/32*c*

The relationship between the value of increased portion (percentage of increase) A of heat dissipation amount of the main heater 31 and the safety circuit operation performance, the fixing property and hot offset will be described in the following Table 2. For the assessments shown in Table 2, the sub heater is not provided with a high resistance part. Among respective assessments, an item on safety circuit operation was measured on whether or not the thermoswitch operated within a stipulated period with only the main heater brought into heat generating at electrical power supply ratio of 100% without paper feeding to the fixing nip (without temperature control by the thermistor 37). The item on fixing property relates to the case where paper with maximum size (width A in FIG. 7) was brought into continuous fixing and paper with minimum size (width B in FIG. 7) was brought into continuous fixing, while electrical power supply to the main heater and to the sub heater was controlled so that the detected temperature of the thermistor 37 is maintained at the target temperature to provide satisfactory fixing property of the toner. As having been described above, the electrical power supply ratio to the main heater and to the sub heater at the time when paper with the maximum size is brought into fixing is 100:100 while the electrical power supply ratio to the main heater and to the sub heater at the time when paper with the minimum size is brought into fixing is 100:0. And it was measured whether or not the toner is brought into fixing sufficiently. The item of hot offset relates to a research on whether or not the toner onto the fixing film 24 is set off subject to continuous fixing. Here, the cell "Not measured" is a cell selfevidently OK or NG without requiring measurement.

TABLE 2

| Main heater heat dissipation increased portion: A(%) | Operation of safety circuit | Fixing property | Hot offset |
|---|---|---|---|
| 0 | OK | OK | OK |
| 25 | OK | OK | OK |
| 50 | OK | OK (however with glossy uneveness) | NG |
| 75 | OK | Not measured | Not measured |
| 100 | Not measured | ↑ | ↑ |

As shown in the item of the safety circuit operation in Table 2, with the value A of heat dissipation amount increased percentage (resistance value increased percentage) being not less than 0%, that is, without any increase, it is understood that the responsiveness of the thermoswitch remains in a satisfactory level.

However, as shown in the item of fixing property, with the value A exceeding 25%, fixing property is satisfactory, but overheating the toner image gave rise to glossy uneveness of the toner image.

In addition, as shown in the item of hot offset, the value A exceeding 25% gave rise to offset to the fixing film 24.

Accordingly, for heat dissipation increased portion A of the main heater 31, not less than 0% and not more than 25% is appropriate.

Next, the relationship between the value of increased portion (percentage of increase) B of heat dissipation amount of the sub heater 32 and the safety circuit operation performance, the fixing property and hot offset will be described in the following Table 3. For the assessments shown in Table 3, the main heater is not provided with a high resistance part. Among respective assessments, an item on safety circuit operation was measured on whether or not the thermoswitch operated within a stipulated period with only the sub heater brought into heat generating at electrical power supply ratio of 100% without paper feeding to the fixing nip (without temperature control by the thermistor 37). The item on fixing property relates to the case where paper with maximum size (width A in FIG. 7) was brought into continuous fixing and paper with minimum size (width B in FIG. 7) was brought into continuous fixing, while electrical power supply to the main heater and to the sub heater was controlled so that the detected temperature of the thermistor 37 is maintained at the target temperature to provide satisfactory fixing property of the toner. As having been described above, the electrical power supply ratio to the main heater and to the sub heater at the time when paper with the maximum size is brought into fixing is 100:100 while the electrical power supply ratio to the main heater and to the sub heater at the time when paper with the minimum size is brought into fixing is 100:0. Thereby, it was measured whether or not the toner was brought into fixing sufficiently.

The item of hot offset relates to a research on whether or not the toner onto the fixing film 24 is set off subject to continuous fixing. Here, the cell "Not measured" is a cell selfevidently OK or NG without requiring measurement.

TABLE 3

| Sub heater heat dissipation increased portion: B(%) | Operation of safety circuit | Fixing property | Hot offset |
|---|---|---|---|
| 0 | NG | NG | Not measured |
| 25 | NG | OK | OK |
| 50 | OK | OK | OK |
| 75 | OK | OK | OK |
| 90 | OK | OK | OK |
| 100 | OK | OK | OK |
| 120 | NG | OK (however with glossy uneveness) | OK |

As shown in the item of the safety element operation in Table 3, with the value B of heat dissipation amount increased percentage (resistance value increased percentage) being 0% and 25%, responsiveness of the thermoswitch was bad.

In addition, with the value B being 120%, the high resistance part is overheated and therefore the thermoswitch was brought into mal-operation, resulting in NG.

In addition, as shown in the item of fixing property, with the value B being 120%, fixing property is satisfactory, but overheating the toner image gave rise to glossy uneveness.

As concerns the item of hot offset, all data were on levels without problems.

Accordingly, for heat dissipation increased portion B of the sub heater 32, not less than 50% and not more than 100% is appropriate.

Based on the above described result, the heat dissipation amount increased portions A and B respectively of the part of the main heater 31 and the part of the sub heater 32 corresponding to the thermoswitch installation location part 40*a* in the present embodiment were determined as follows.

A=5%, B=80%

As in the present embodiment, in the case where the thermoswitch 40 is disposed in the location slightly apart from the region (however, within the minimum size recording material conveyance region B) with the lowest heat dissipation amount (resistance value) of the sub heater 32 (the location of the conveyance reference E in the present embodiment), as for the heat dissipation amount increased percentage (resistance value increased percentage) A of the main heater 31 being not less than 0% and not more than 25% and as for the heat dissipation amount increased percentage (resistance value increased percentage) B of the sub heater 32 being not less than 50% and not more than 100% are respectively preferable, but since the location of the thermoswitch is not the heat dissipation peak location of the main heater, it is advisable to provide the main heater (the first heat generating resistor) as well with a high resistance part for compensating heat transfer to the thermoswitch 40. That is, setting at 0%<A(25% and 50% (B(100% is more preferable.

Adopting such a configuration as described above, with a heater having a first heat generating resistor (main heater 31) providing decreasing heat dissipation amount from the center to the end in its longitudinal direction and a second heat generating resistor (sub heater 32) providing increasing heat dissipation amount from the center to the end in its longitudinal direction, in case of disposing the safety element part in the location slightly apart from the region with the lowest heat dissipation amount (resistance value) of the sub heater (the location in the center in the longitudinal direction in the present embodiment) as well, uneven heating and response time lag depending on heat capacity of the safety element could be prevented.

In the present study, the heat dissipation increased portions A=5% and B=80% were stipulated, but as a result of Table 2 and Table 3, any configuration fulfilling A<B gives rise to similar effects.

Moreover, cracking in heater at the time of heat dissipation runaway due to malfunction in CPU and the like could be prevented.

Figure 8A:
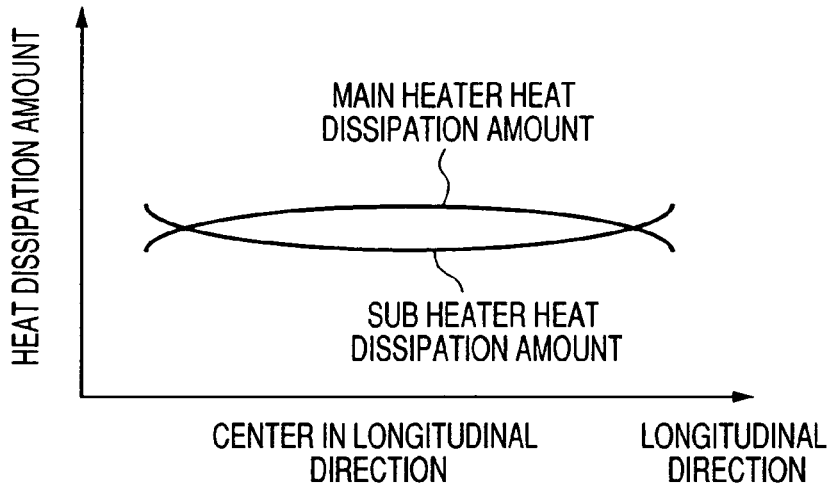
FIGS. 8A, 8B and 8C show respective kinds of heat distribution of a main heater and a sub heater of a heater on the center line.
Figure 8B:
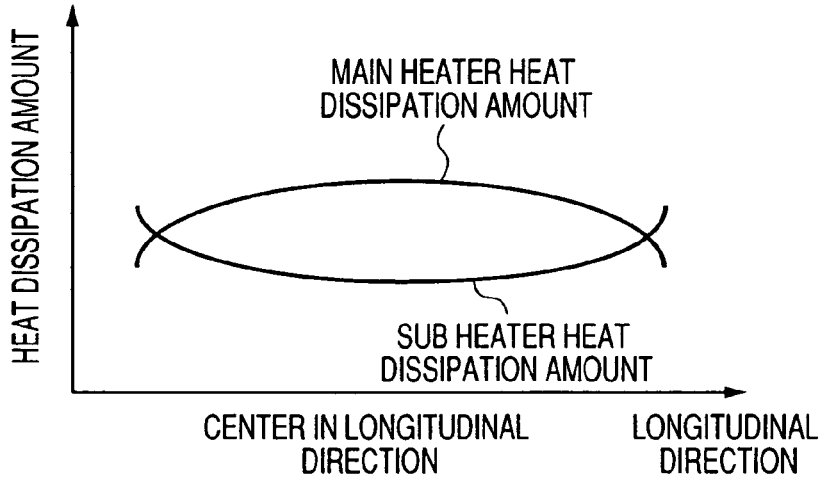
Figure 8C:
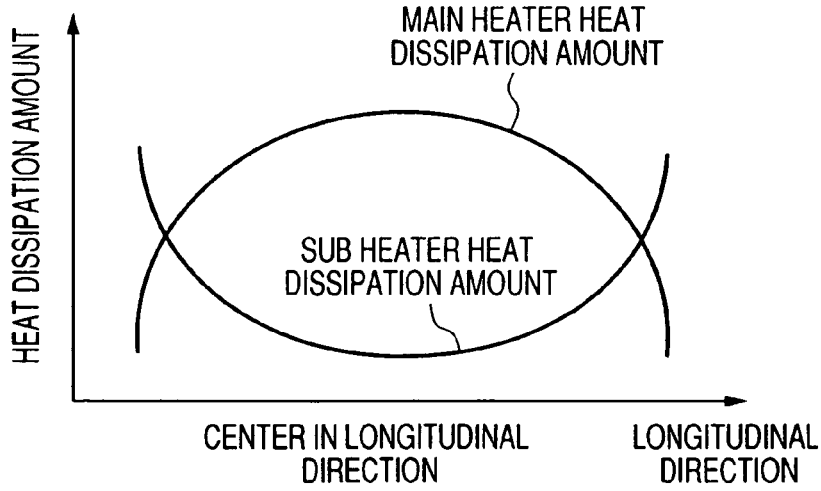

In the present study, the heater with the heat dissipation distribution as in FIG. 8A was used, but heaters with the heat dissipation distribution tendency as in FIGS. 8A, 8B or 8C are applicable. Keeping the heat dissipation amount increased portions A and B respectively of the part of the main heater 31 and the part of the sub heater 32 corresponding to the thermoswitch contact location part 40*a* at the tendency of A<B, in case of disposing the safety element part in the location other than the location in the center in the longitudinal direction of the heater as well, uneven heating and response time lag depending on heat capacity of the safety element can be prevented, and moreover, cracking in heater at the time of heat dissipation runaway due to malfunction in CPU and the like could be prevented.

Here, FIGS. 8A, 8B and 8C respectively show the cases with the heater heat dissipation amount in the center for the heat dissipation amount in the end of the heater is 120%, 160% and 200%. For example, "120%" in FIG. 8A means that the heat dissipation distribution of the heater is set to give rise to 120 as heat dissipation amount of the center part thereof in the longitudinal direction as for the main heater when the heat dissipation amount is set at 100 at the end in the longitudinal direction and to give rise to 120 as heat dissipation amount of the end part thereof in the longitudinal direction as for the sub heater when the heat dissipation amount of the center in the longitudinal direction is set at 100. "160%" in FIG. 8B means that the heat dissipation distribution of the heater is set to give rise to 160 as heat dissipation amount of the center part thereof in the longitudinal direction as for the main heater when the heat dissipation amount is set at 100 at the end in the longitudinal direction and to give rise to 160 as heat dissipation amount of the end part thereof in the longitudinal direction as for the sub heater when the heat dissipation amount of the center in the longitudinal direction is set at 100. "200%" in FIG. 8C means that the heat dissipation distribution of the heater is set to give rise to 200 as heat dissipation amount of the center part thereof in the longitudinal direction as for the main heater when the heat dissipation amount is set at 100 at the end in the longitudinal direction and to give rise to 200 as heat dissipation amount of the end part thereof in the longitudinal direction as for the sub heater when the heat dissipation amount of the center in the longitudinal direction is set at 100.

As described above, the heater mounted on the fixing apparatus of the present embodiment has a substrate, a main as well as sub heat generating resistor formed on the substrate and most region of the main heat generating resistor has resistance value per unit length getting smaller and smaller toward the end in the longitudinal direction of the substrate while most region of the sub heat generating resistor has resistance value per unit length getting larger and larger toward the end. In addition, electrical power supply to the main heat generating resistor and electrical power supply to the sub heat generating resistor are individually controllable. In addition, both of the main and the sub heat generating resistors have high resistance part corresponding to safety elements in a part thereof in the longitudinal direction, and the high resistance part of the sub heat generating resistor have larger resistor value increased percentage than the high resistance part of the main heat generating resistor (A<B). This configuration can ensure responsiveness of the safety element even in the case where only the sub heat generating resistor has run away. Especially, this configuration is effective in case of the safety element being located apart from the region with the minimum heat dissipation amount (resistance value) of the sub heat generating resistor.

Here, as having been described with respect to the first embodiment, the shape of the heat generating resistor will not be limited to the one depicted in FIG. 7.

Third Embodiment

The third embodiment of the present invention will be described. The present embodiment is a variation of Embodiment 1. In the present embodiment, the recording material conveyance reference G is at the end part of the heat generating resistor in the longitudinal direction (end part line).

For the image forming apparatus configuration to which the present embodiment is applied, description on the configuration of the main body and the configuration of the fixing apparatus which are similar to those in the above described embodiment 1 will be omitted. However, in the present embodiment, the recording material 12 is conveyed along the end line.

Figure 9:
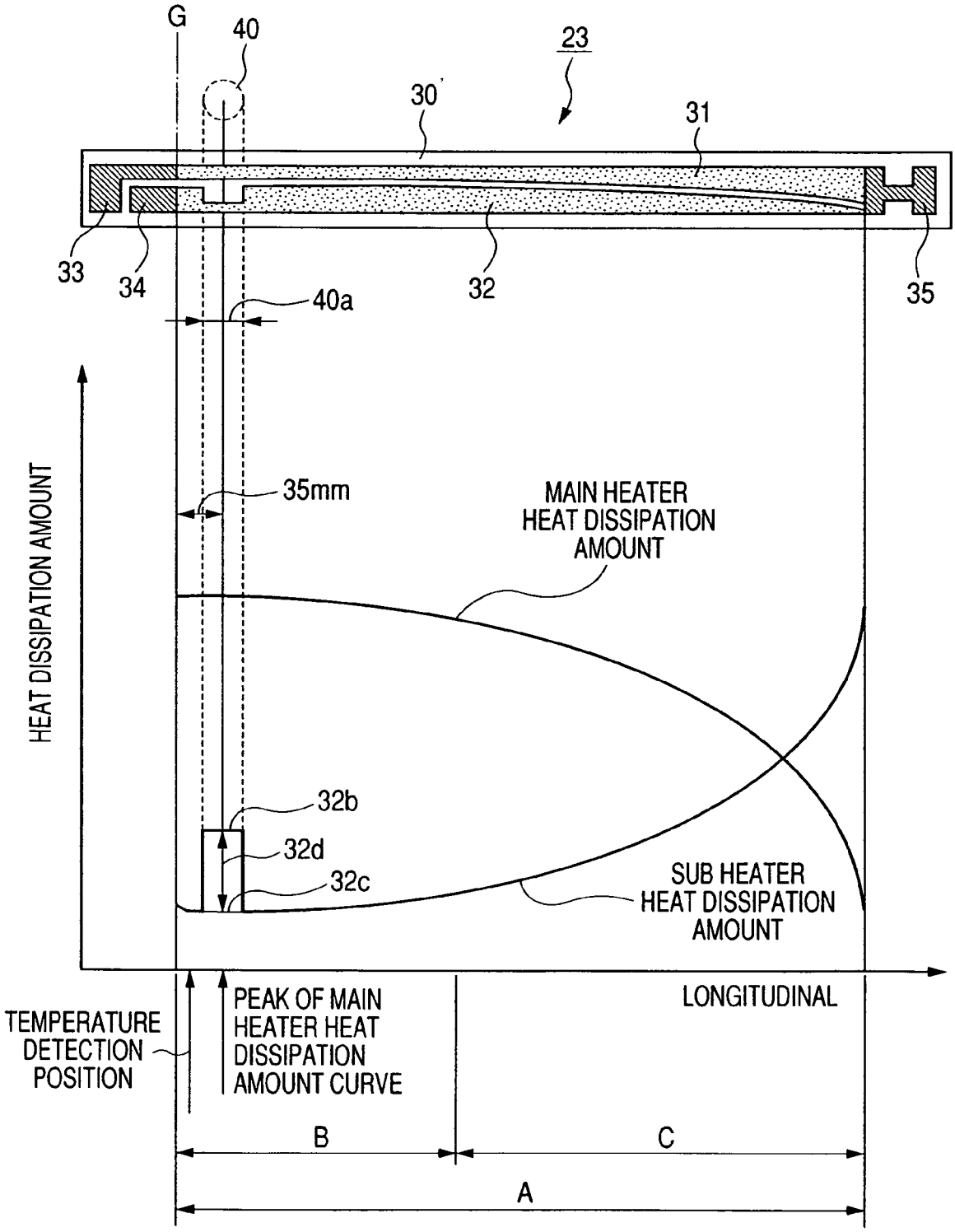
FIG. 9 is an explanatory diagram of a pattern shape and heat distribution of a heat generating resistor of a heater in Embodiment 3.

FIG. 9 shows the heat generating resistor pattern and heat dissipation distribution of the heater in the present embodiment. Reference character G denotes an end line being a recording material conveyance reference.

As for the present heater 23 of the end line, on the heat-resisting substrate 30 made of almina and the like, a first heat generating resistor pattern 31 as a main heater and a second heat generating resistor pattern 32 as a sub heater are formed by thick film printing. These main heater 31 and sub heater 32 are respectively formed along the heater in the longitudinal direction and arranged in the recording material conveyance direction. The main heater 31 and the sub heater 32 bring heat dissipation into continuous change from the end line G being the recording material conveyance reference to the opposite end part. The main heater 31 and the sub heater 32 have their maximum point and minimum point of heat dissipation distribution in the location 35 mm apart from the conveyance reference G respectively (in case of lacking a high resistor part corresponding to a safety element), the main heater 31 is made to decrease its heat dissipation amount from the maximum point of heat dissipation distribution to the both end parts. The sub heater 32 is made to increase its heat dissipation amount from the minimum point of heat dissipation distribution to the both end parts. As concerns regions other than a part of region of heat generating resistor corresponding to the safety element installation site 40*a*, the summed heat dissipation amount of the heat dissipation amount of the main heater 31 and the heat dissipation amount of the sub heater 32 is approximately even along the heat generating resistor in the longitudinal direction. In addition, with respect to the sub heater 32, the heat dissipation amount in the portion (high resistance part) corresponding to the safety element installation site 40*a* is not maximum in the heat generating resistor longitudinal direction. In addition, in the present embodiment likewise Embodiment 1, the high resistance part compensating heat transfer to the safety element is provided only to the sub heater 32 (a portion 32*b* in FIG. 9) while the main heater 31 is not provided with such a high resistance part. In addition, the heat dissipation peak location of the main heater 31 in the longitudinal direction coincides with and the location of the safety element.

In the present embodiment, the thermoswitch 40 is used as the safety element. The thermoswitch 40 is disposed in the location 35 mm apart from the conveyance reference G, or the same location as the maximum point and the minimum point of heat dissipation distribution respectively of the main heater 31 and the sub heater 32.

When a large-sized paper is brought into fixing, the electrical power supply ratio to the main heater and the sub heater is made approximately even. In addition, when a small sized paper is brought into fixing, bringing only the main heater 31 into electrical power supply, or putting mainly the main heater 31 on, or equalizing the number of sheet of paper feeding within a predetermined period as in case of fixing on a large sized paper, or slightly reducing the number, non-paper feeding region temperature rise can be controlled and changes in shape of the pressure roller due to non-paper feeding region temperature rise can be controlled. This enables to prevent wrinkles and glossy uneveness due to pressure roller shape. In addition, deterioration in endurance of a heat fixing apparatus can be suppressed and in the case where a large sized paper is brought into fixing, the toner image can be prevented from ending in hot offset.

Using a contact type safety element, the thermoswitch 40 used in the present embodiment gives rise to uneven heating and response time lag due to heat capacity of the safety element. In order to prevent this harmful effect, it is necessary to make the heat dissipation amount larger in the heater corresponding to the contact point part.

In the present embodiment, the thermoswitch 40 is located in the maximum point of heat dissipation distribution of the main heater 31, and therefore without making the heat dissipation amount large in particular, the main heater 31 does not give rise to uneven heating and response time lag. On the contrary, since the sub heater 32 is significantly affected by the thermoswitch 40, the heat dissipation amount 32*b* of the thermoswitch installation part 40*a* is made larger than the original heat dissipation amount 32*c*. However, making the heat dissipation amount 32*b* of the thermoswitch installation part 40*a* too large gives rise to image defects or hot offset due to getting hot.

Therefore, the heat dissipation increased amount (resistance value increased percentage) in the thermoswitch installation part 40*a* with respect to the main heater 31 and the sub heater 32 is defined as follows.

Increased portion A of heat dissipation amount of main heater 31 A=0 (no increased portion in the present embodiment)

Increased portion B of heat dissipation amount of sub heater 32 B=32*d*/32*c*

Here, the relationship between the value of increased portion (resistance value increased percentage) B of heat dissipation amount of the sub heater 32 and the safety circuit operation performance, the fixing property and hot offset will be described in the following Table 4. The assessment method is the same as in Embodiment 1.

TABLE 4

| Sub heater heat dissipation increased portion: B(%) | Operation of safety circuit | Fixing property | Hot offset |
|---|---|---|---|
| 0 | NG | NG | Not measured |
| 25 | NG | OK | OK |
| 50 | OK | OK | OK |
| 75 | OK | OK | OK |
| 90 | OK | OK | OK |
| 100 | OK | OK (however with glossy uneveness) | OK |

As shown in the item of the safety element operation in Table 4, with the value B of heat dissipation amount increased percentage (resistance value increased percentage) being not less than 50%, it is understood that the responsiveness of the thermoswitch remains in a satisfactory level even if only the sub heater 32 has run away.

In addition, as shown in the item of fixing property, with the value B being not less than 25% and not more than 90%, good fixing property can be ensured regardless paper sizes. Here, with the value B being 0% and in case of bringing paper with the minimum size into fixing, only the main heater 31 generates heat and therefore heat dissipation distribution will be as in case of "main heater heat dissipation amount" in FIG. 9, and since the thermistor 37 detects temperatures in the locations apart from the highest resistance value region (approximately the same as the area 40*a* in FIG. 9) of the main heater 31, electrical power supply control to keep the temperature in the thermistor's detection site at the target temperature will make the heat dissipation amount of the area 40*a* sufficient. However, with the value B being 0% and in case of bringing paper with the maximum size into fixing, the both of the main heater 31 and the sub heater 32 generate heat and therefore the heat dissipation amount in the detection site of the thermistor 37 will get larger than in case of main heater heat dissipation amount. In this case, controlling electrical power supply to the main and the sub heaters to keep the temperature in the thermistor's detection site at the target temperature, electrical power supply period per unit period to the main and the sub heaters will get short than in case of main heater heat dissipation, the heat dissipation amount per unit period in the area 40*a* will get smaller than in case of "main heater heat dissipation amount". Therefore, in case of the value B being 0%, fixing property provides an NG. Since the width size of the heater substrate 30 in the direction perpendicular to the longitudinal direction is limited, it is difficult to dispose the thermoswitch 40 to coincide with the thermistor 37 in the heater substrate longitudinal direction, ending in giving rise to occurrence of NG fixing property as described above according to sizes of paper to be brought into fixing. On the contrary, when the value B reaches 100%, the heat dissipation amount in the area 40*a* rises so large to end in occurrence of image defect incurring glossy uneveness while fixing property is OK.

Here, as concerns the item of hot offset, while the value B falls within the rage of 0 to 100%, no effect enough to give rise to hot offset was seen.

Accordingly, for heat dissipation increased portion B of the sub heater 32 fulfilling the above described conditions, not less than 50% and not more than 90% is appropriate. Based on this result, in the present embodiment, the heat dissipation amount increased portions A and B respectively of the main heater 31 and the sub heater 32 in the thermoswitch installation part 40*a* were determined as follows.

A=0%, B=80%

Adopting such a configuration as described above, with a heater having a heat generating resistor (main heater 31) providing decreasing heat dissipation amount from the maximum point of the heat dissipation distribution to the both end parts and a heat generating resistor (sub heater 32) providing increasing heat dissipation amount from the maximum point of the heat dissipation distribution to the both end parts, uneven heating and response time lag depending on heat capacity of the safety element could be prevented. Moreover, cracking in heater at the time of heat dissipation runaway due to malfunction in CPU and the like could be prevented.

As described above, the heater mounted on the fixing apparatus of the present embodiment has a substrate, a main as well as sub heat generating resistor formed on the substrate and most region of the main heat generating resistor has resistance value per unit length getting smaller and smaller toward the end in the longitudinal direction of the substrate while most region of the sub heat generating resistor has resistance value per unit length getting larger and larger toward the end. In addition, electrical power supply to the main heat generating resistor and electrical power supply to the sub heat generating resistor are individually controllable. In addition, of the main and the sub heat generating resistors, only the sub heat generating resistor has a high resistance portion corresponding with a safety element in a part of its longitudinal direction. This configuration can ensure responsiveness of the safety element even in the case where only the sub heat generating resistor has run away.

Moreover, the high resistance part of the sub heat generating resistor is disposed in the same place in the substrate longitudinal direction as the region with the largest resistance of the main heat generating resistor. This configuration is to deprive heat shortage in the safety element disposition region even in case of heating only the main heat generating resistor as in the time when a small-sized sheet is brought into fixing.

Here, the resistor pattern of this embodiment has resistor values changing by changing the width of the resistor in the recording material conveyance direction with a smooth curve, but the other heat generating member pattern or the other heat generating material can be used to give rise to the similar effects. That is, the resistor value may be shifted by changing the width of the resistor stepwise or changing the resistor material gradually along the longitudinal direction.

Fourth Embodiment

The fourth embodiment of the present invention will be described as follows. The present embodiment is a variation of Embodiment 2. In the present embodiment, the recording material conveyance reference G is at the end part of the heat generating resistor in the longitudinal direction (end part line). The location with the highest resistance value of the main heater 31 (the location with the heat dissipation peak in case of lacking a high resistance part) and the location with the lowest resistance value of the sub heater 32 coincide with the line G. In addition, likewise the second embodiment, the high resistance part corresponding to the safety element is provided to both of the main heater (the first heat generating resistor) and sub heater (the second heat generating resistor) and the location of the safety element (the location of the high resistance part of heat generating resistor) is disposed in a location apart from the lowest resistance value of the sub heater (the location of line G in the present embodiment). In addition, the position of temperature detection by the thermistor is between the line G and the area 40*a*.

For the image forming apparatus configuration to which the present embodiment is applied, description on the configuration of the main body and the configuration of the fixing apparatus which are similar to those in the above described first embodiment 1 will be omitted. In addition, in the present embodiment, the recording material 12 is conveyed along the end line as in case of the above described third embodiment.

Figure 10:
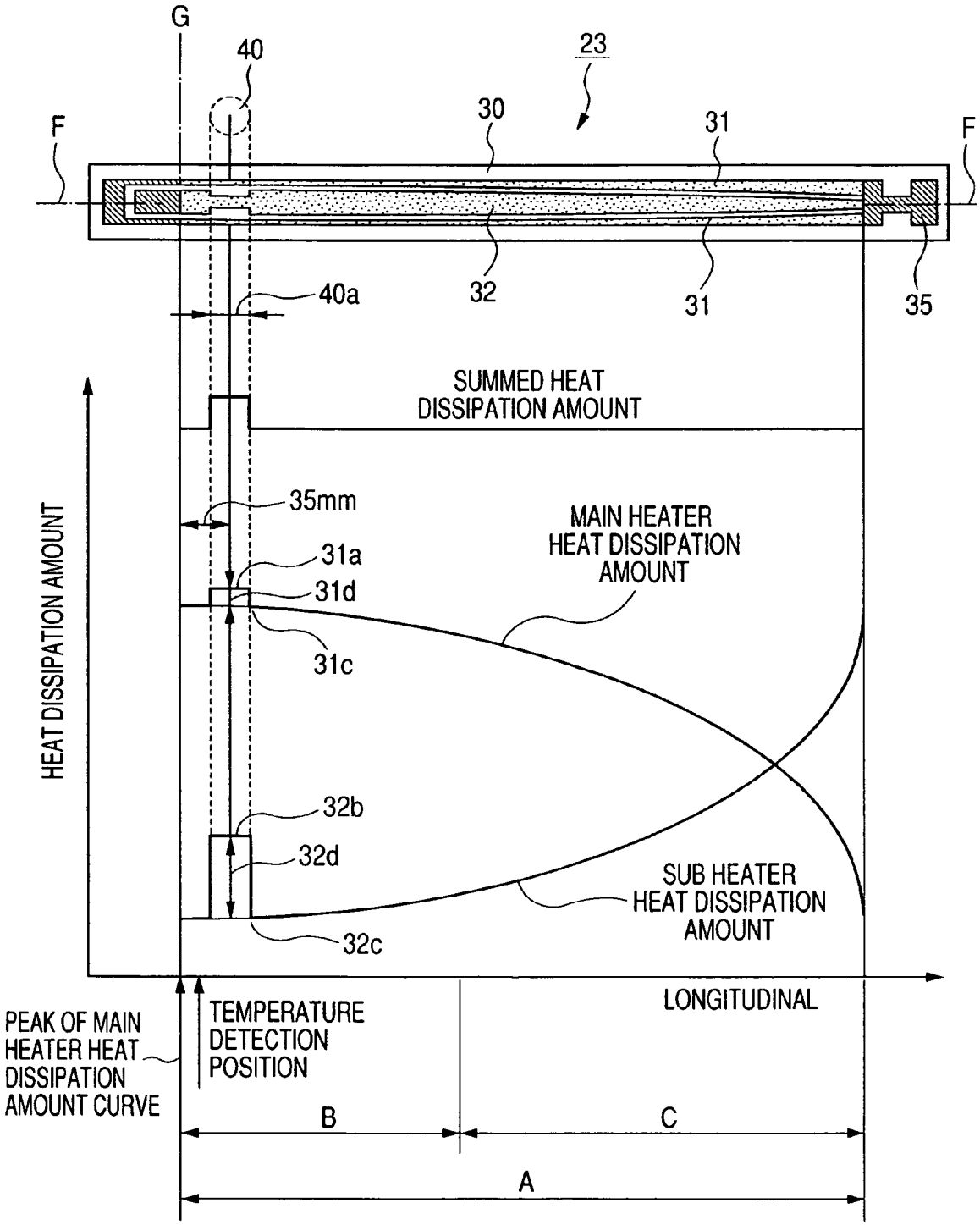
FIG. 10 is an explanatory diagram of a pattern shape and heat distribution of a heat generating resistor of a heater in Embodiment 4.

FIG. 10 shows the heat generating resistor pattern and heat dissipation distribution of the heater in the present embodiment. The heater of the present embodiment has three heat generating resistors or heat generating resistors 31, 32 and 31 which make heat fluxes axisymmetric in the upward and downward directions to the perpendicular to the paper feeding direction. Reference character F denotes the axisymmetric axis thereof.

The two outside heat generating resistors 31, 31 will be described as main heaters. The inside heat generating resistor 32 will be described as a sub heater. The patterns of the main heaters 31, 31 and the sub heater 32 are brought into continuous change from the center to the both ends in the longitudinal direction. The both of outside two main heaters 31 and 31 have large heat dissipation amount (resistance value per unit length) in the end part in the paper feeding line G side, and the heat dissipation amounts toward the opposite end parts (the right sides in FIG. 10) decrease. In addition, in order to overcome thermal stress, the main heater 31 is shaped axisymmetric to the substrate center F in the paper feeding direction. The sub heater 32 provides large heat dissipation amount in the end located right from the paper feeding line G side and, in order to correspond with thermal stress likewise in case of the main heaters 31, 31, is shaped axisymmetric to the substrate center F in the paper feeding direction. In addition, as for other than the heat generating resistor portion corresponding to the safety element installation location 40*a*, the summed heat dissipation amount (summed resistor value) of the heat dissipation amounts of the main heaters 31, 31 and the heat dissipation amount of the sub heater 32 are approximately even in the longitudinal direction of the heat generating resistor except the high resistance part.

Likewise the second embodiment, when a large sized paper is brought into fixing, the electrical power supply ratios to the main heater and to the sub heater are made approximately even. In addition, when a small sized paper is brought into fixing, bringing only the main heater 31 into electrical power supply, or putting mainly the main heater 31 on, or equalizing the number of sheet of paper feeding within a predetermined period as in case of fixing on a large sized paper, or slightly reducing the number, non-paper feeding region temperature rise can be controlled and changes in shape of the pressure roller due to non-paper feeding region temperature rise can be controlled. This enables to prevent wrinkles and glossy uneveness due to pressure roller shape. In addition, deterioration in endurance of a heat fixing apparatus can be controlled and in the case where a large sized paper is brought into fixing, the toner image can be prevented from ending in hot offset.

In the present embodiment, the thermoswitch 40 is used as the safety element. The thermoswitch 40 is disposed in the location 35 mm apart from the conveyance reference G. Use of a contact type safety element gives rise to uneven heating and response time lag due to heat capacity of the safety element. In order to prevent this harmful effect, the heat dissipation amounts 31*a* and 32*b* in the portions corresponding to the thermoswitch contact location portion 40*a* of the main heaters 31, 31 and the sub heater 32 is made larger than the heat dissipation amounts 31*c* and 32*c* in the portions adjacent to the safety element contact location portion 40*a*. Making the heat dissipation amounts 31*a* and 32*b* too large gives rise to image defects or hot offset due to getting hot. Therefore, the heat dissipation increased portion in the thermoswitch installation part 40*a* with respect to the main heater 31 and the sub heater 32 will be described in terms of percentage as follows.

Increased portion A of heat dissipation amount of main heater 31 A=31*d*/31*c*

Increased portion B of heat dissipation amount of sub heater 32 B=32*d*/32*c*

Here, the relationship between the value of increased portion (resistance value increased percentage) A of heat dissipation amount of the main heater 31 and the safety circuit operation performance, the fixing property and hot offset will be described in the following Table 5. For the assessments shown in Table 5, the sub heater is not provided with a high resistor part. Among respective assessments, an item on safety circuit operation was measured whether or not the thermoswitch operated within a stipulated period with only the main heater brought into heat generating at electrical power supply ratio of 100% without paper feeding to the fixing nip (without temperature control by the thermistor 37). The item on fixing property relates to the case where papers with maximum size (width A in FIG. 10) were brought into continuous fixing and papers with minimum size (width B in FIG. 10) were brought into continuous fixing, while electrical power supply to the main heater and to the sub heater was controlled so that the detected temperature of the thermistor 37 is maintained at the target temperature to provide satisfactory fixing property of the toner. As having been described above, the electrical power supply ratio to the main heater and to the sub heater at the time when paper with the maximum size is brought into fixing is 100:100 while the electrical power supply ratio to the main heater and to the sub heater at the time when paper with the minimum size is brought into fixing is 100:0. And it was measured whether or not the toner is brought into fixing sufficiently. The item of hot offset relates to a research on whether or not the toner onto the fixing film 24 is set off subject to continuous fixing. Here, the cell "Not measured" is a cell selfevidently OK or NG without requiring measurement.

TABLE 5

| Main heater heat dissipation increased portion: A(%) | Operation of safety circuit | Fixing property | Hot offset |
|---|---|---|---|
| 0 | OK | OK | OK |
| 25 | OK | OK | OK |
| 50 | OK | OK (however with glossy uneveness) | NG |
| 75 | OK | Not measured | Not measured |
| 100 | Not measured | ↑ | ↑ |

As shown in the item of the safety circuit operation in Table 5, with the value A of heat dissipation amount increased percentage (resistor value increased percentage) being not less than 0%, that is, without any increase, it is understood that the responsiveness of the thermoswitch remains in a satisfactory level.

However, as shown in the item of fixing property, with the value A exceeding 25%, fixing property is satisfactory, but overheating the toner image gave rise to glossy uneveness of the toner image.

In addition, as shown in the item of hot offset, the value A exceeding 25% gave rise to offset to the fixing film 24.

Accordingly, for heat dissipation increased portion A of the main heater 31, not less than 0% and not more than 25% is appropriate.

Next, the relationship between the value of increased portion B of heat dissipation amount (resistance value increased percentage) of the sub heater 32 and the safety circuit operation performance, the fixing property and hot offset will be described in the following Table 6. For the assessments shown in Table 6, the main heater is not provided with a high resistor part. Among respective assessments, an item on safety circuit operation was measured whether or not the thermoswitch operated within a stipulated period with only the sub heater brought into heat generating at electrical power supply ratio of 100% without paper feeding to the fixing nip (without temperature control by the thermistor 37). The item on fixing property relates to the case where paper with maximum size (width A in FIG. 10) was brought into continuous fixing and paper with minimum size (width B in FIG. 10) was brought into continuous fixing, while electrical power supply to the main heater and to the sub heater was controlled so that the detected temperature of the thermistor 37 is maintained at the target temperature to provide satisfactory fixing property of the toner. As having been described above, the electrical power supply ratio to the main heater and to the sub heater at the time when paper with the maximum size is brought into fixing is 100:100 while the electrical power supply ratio to the main heater and to the sub heater at the time when paper with the minimum size is brought into fixing is 100:0. Thereby, it was measured whether or not the toner was brought into fixing sufficiently. The item of hot offset relates to a research on whether or not the toner onto the fixing film 24 is set off subject to continuous fixing. Here, the cell "Not measured" is a cell selfevidently OK or NG without requiring measurement.

TABLE 6

| Sub heater heat dissipation increased portion: B(%) | Operation of safety circuit | Fixing property | Hot offset |
|---|---|---|---|
| 0 | NG | NG | Not measured |
| 25 | NG | OK | OK |
| 50 | OK | OK | OK |
| 75 | OK | OK | OK |
| 90 | OK | OK | OK |
| 100 | OK | OK | OK |
| 120 | NG | OK (however with glossy uneveness) | OK |

As shown in the item of the safety element operation in Table 6, with the value B of heat dissipation amount increased percentage (resistance value increased percentage) being 0% and 25%, responsiveness of the thermoswitch was bad. In addition, with the value B being 120%, the high resistor part is overheated and therefore the thermoswitch was brought into mal-operation while a fixing step, resulting in NG.

In addition, as shown in the item of fixing property, with the value B being 120%, fixing property is satisfactory, but overheating the toner image gave rise to glossy uneveness.

As concerns the item of hot offset, all data were on levels without problems.

Accordingly, for heat dissipation increased portion B of the sub heater 32, not less than 50% and not more than 100% is appropriate.

Based on the above described result, the heat dissipation amount increased portions A and B respectively of the part of the main heaters 31, 31 and the part of the sub heater 32 corresponding to the thermoswitch installation location part 40*a* in the present embodiment were determined as follows.

A=5%, B=80%

As in the present embodiment, in the case where the thermoswitch 40 is disposed in the location slightly apart from the region (however, within the minimum size recording material conveyance region B) with the lowest heat dissipation amount (resistance value) of the sub heater 32 (the location of the conveyance reference E in the present embodiment), as for the heat dissipation amount increased percentage (resistance value increased percentage) A of the main heater 31 being not less than 0% and not more than 25% and as for the heat dissipation amount increased percentage (resistance value increased percentage) B of the sub heater 32 being not less than 50% and not more than 100% are respectively preferable, but since the location of the thermoswitch is not the heat dissipation peak location of the heater, it is advisable to provide the main heater (the first heat generating resistor) as well with a high resistor part for compensating heat transfer to the thermoswitch 40. That is, setting at $0\% < A \leqq 25\%$ and $50\% \leqq B \leqq 100\%$ is more preferable.

Adopting such a configuration as described above, with a heater having a heat generating resistor providing a maximum point and a minimum point of heat dissipation amount located on the recording material paper feeding line, and a heat generating resistor providing decreasing heat dissipation amount from the paper feeding line to the end, and a heat generating resistor providing increasing heat dissipation amount from the paper feeding line to the end, in case of disposing the safety element part in the location other than the maximum point and the minimum point of heat dissipation amount of the heat generating resistor as well, uneven heating and response time lag depending on heat capacity could be prevented.

In the present study, A=5% and B=80% were stipulated, but based on Tables 5 and 6, any configuration fulfilling A<B gives rise to similar effects.

Moreover, cracking in heater at the time of heat dissipation runaway due to malfunction in CPU and the like could be prevented.

Figure 11A:
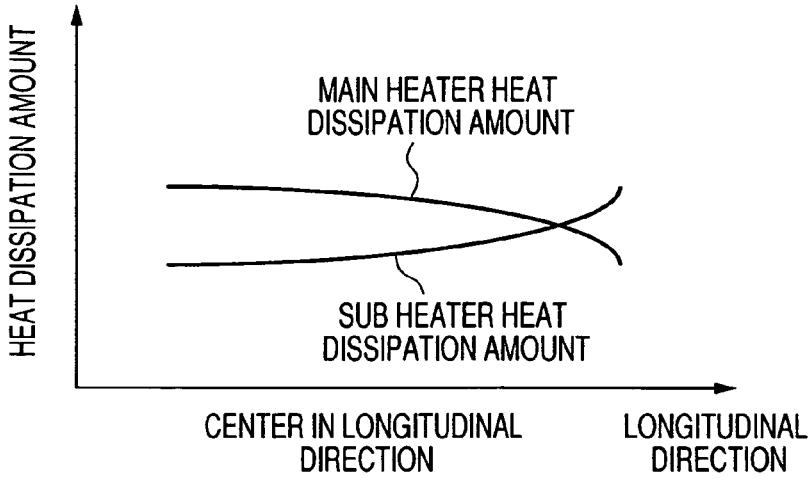
FIGS. 11A 11B and 11C show respective kinds of heat distribution of a main heater and a sub heater of a heater on the end line.
Figure 11B:
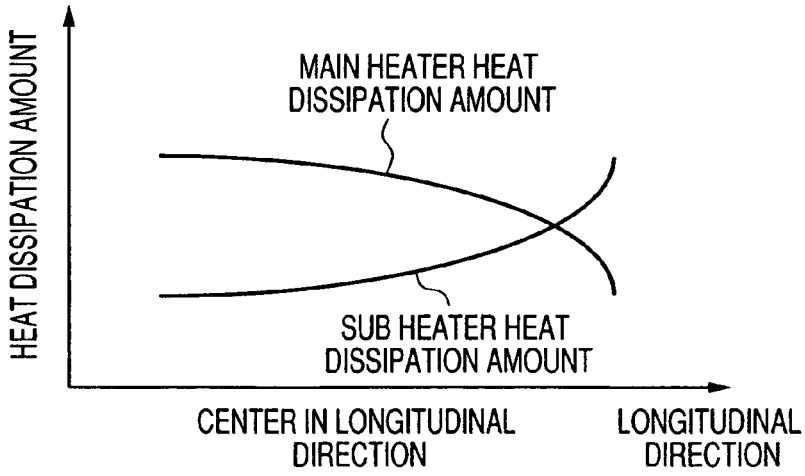
Figure 11C:
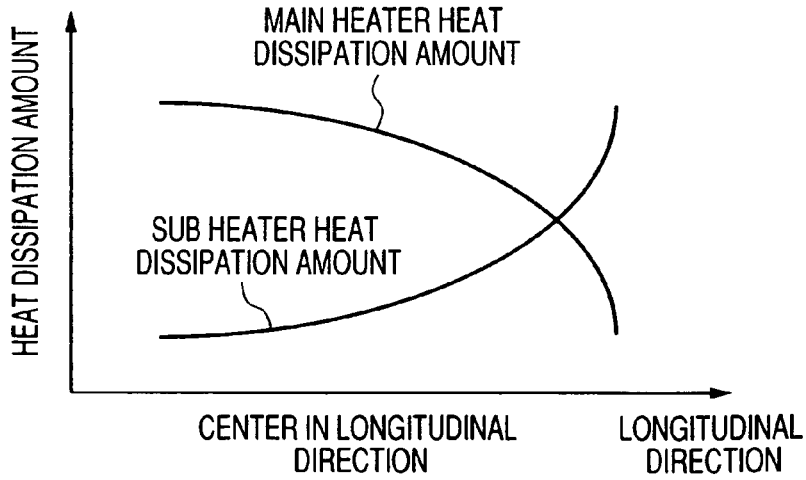
Figure 12A:
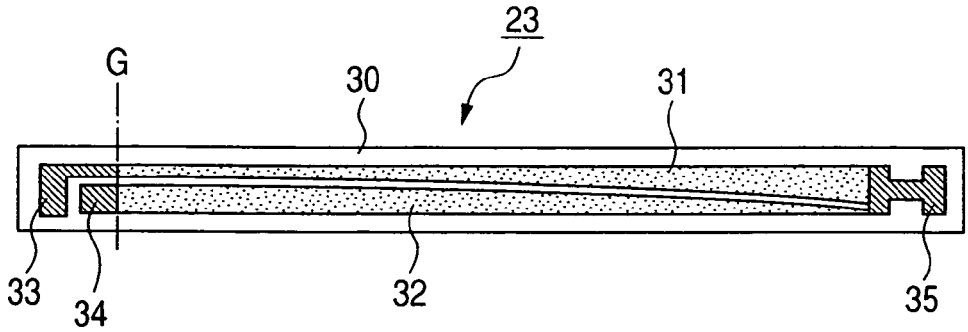
FIGS. 12A, 12B, 12C and 12D show respective kinds of heat generating resistor patterns of a main heater and a sub heater of a heater on the end line.
Figure 12B:
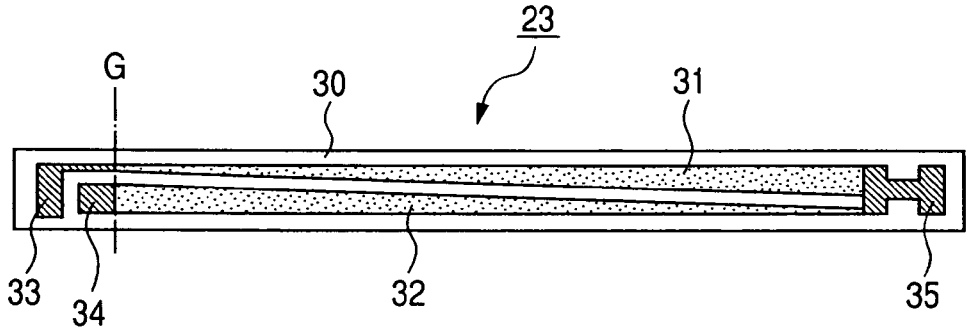
Figure 12C:
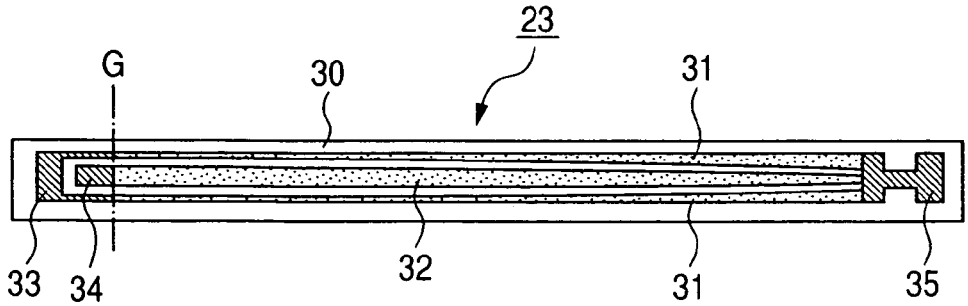
Figure 12D:
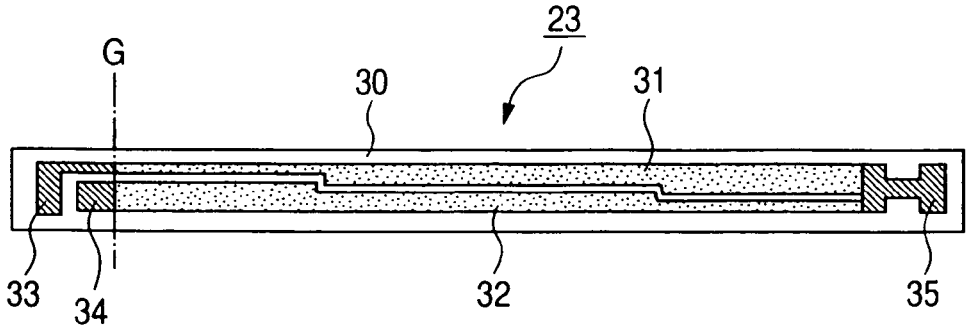

In the present study, a heater with heat dissipation distribution as in FIG. 11A, but also with a heater providing tendency of heat dissipation distribution as in FIG. 11B or 11C, maintaining the tendency of heat dissipation increase being A<B, in case of disposing the safety element part in the location other than the center, uneven heating and response time lag depending on heat capacity can be prevented, and moreover, cracking in heater at the time of heat dissipation runaway due to malfunction in CPU and the like could be prevented.

Here, likewise FIGS. 8A, 8B and 8C, with regard to 120% in FIG. 11A, the heat dissipation distribution of the heater is set to give rise to 120 as heat dissipation amount in the end part line as for the main heater when the heat dissipation amount is set at 100 in the non-end part line side in the opposite side of the end part line side (recording material conveyance reference side) and to give rise to 120 as heat dissipation amount in the end part line side as for the sub heater when the heat dissipation amount of the end part line side is set at 100. With regard to 160% in FIG. 11B, the heat dissipation distribution of the heater is set to give rise to 160 as heat dissipation amount in the end part line side as for the main heater when the heat dissipation amount is set at 100 in the non-end part line side and to give rise to 160 as heat dissipation amount in the non-end part line side as for the sub heater when the heat dissipation amount in the end part line side is set at 100. With regard to 200% in FIG. 1C, the heat dissipation distribution of the heater is set to give rise to 200 as heat dissipation amount in the end part line side as for the main heater when the heat dissipation amount is set at 100 in the non-end part line side and to give rise to 200 as heat dissipation amount in the non-end part line side as for the sub heater when the heat dissipation amount in the end part line side is set at 100.

As described above, the heater mounted on the fixing apparatus of the present embodiment has a substrate, a main as well as sub heat generating resistor formed on the substrate and most region of the main heat generating resistor has resistance value per unit length getting smaller and smaller toward the end in the longitudinal direction of the substrate while most region of the sub heat generating resistor has resistance value per unit length getting larger and larger toward the end. In addition, electrical power supply to the main heat generating resistor and electrical power supply to the sub heat generating resistor are individually controllable. In addition, both of the main and the sub heat generating resistors have high resistance part corresponding to safety elements in a part thereof in the longitudinal direction, and the high resistance part of the sub heat generating resistor have a larger resistor value increased percentage than the high resistance part of the main heat generating resistor (A<B). This configuration can ensure responsiveness of the safety element even in the case where only the sub heat generating resistor has run away. Especially, this configuration is effective in case of the safety element being located apart from the region with the minimum heat dissipation amount (resistor value) of the sub heat generating resistor.

In order to attain the results described above, in a configuration with a different heat dissipation distribution in the longitudinal direction, the other heat generating member pattern or the other heat generating material can be used to give rise to the similar effects.

FIGS. 12A to 12D exemplify respective kinds of heat generating resistor patterns of the heater with end part line. For any of them, in order to prevent wrinkles and glossy uneveness due to non-paper feeding region temperature rise, a first heat generating resistor (main heater) 31 and a second heat generating resistor (sub heater) 32 on the heater substrate 30 are formed to have heat generating resistor width so that the heat dissipation amount changes from the paper feeding line (end part line) G to the end part and thereby change the heat dissipation distribution in the longitudinal direction. As for the first heat generating resistor 31, the heat dissipation amount in the paper feeding line G side is made large while as for the second heat generating resistor 32, the heat dissipation amount in the paper feeding line G side is made small. With such a heater 23, at the time of bringing small-sized paper into paper feeding, putting mainly the first heat generating resistor 31 on, non-paper feeding region temperature rise is controlled.

This application claims priority from Japanese Patent Application Nos. 2004-182417 filed on Jun. 21, 2004 and 2005-151019 filed on May 24, 2005, which are hereby incorporated by reference herein.

What is claimed is:

1. An image heating apparatus for heating an image formed on a recording material, comprising:

a heater having a substrate and first and second heat generating resistors formed on said substrate, most of the region of said first heat generating resistor having smaller resistance value per unit length toward an end in the longitudinal direction of said substrate, and most of the region of said second heat generating resistor having larger resistance value per unit length toward the end;

wherein an electrical power supply to said first heat generating resistor and an electrical power supply to said second heat generating resistor are individually controllable, a safety element which operates in response to the heat of said heater to cut off electrical power supply to said first and second heat generating resistors; and wherein only said second heat generating resistor in said first and second heat generating resistors has a high resistance part corresponding to said safety element in a part in the longitudinal direction thereof.

2. An image heating apparatus according to claim 1, wherein the high resistance part is a portion of said second heat generating resistor with the width in the direction perpendicular to the longitudinal direction being squeezed more than the both of adjacent portions in the longitudinal direction.

3. An image heating apparatus according to claim 1, wherein said safety element is electrically connected a power supply with said first and second heat generating resistors.

4. An image heating apparatus according to claim 1, wherein the high resistance part of said second heat generating resistor is disposed in the same location as a region with the highest resistance value of said first heat generating resistor in the longitudinal direction.

5. An image heating apparatus according to claim 4, further comprising a temperature detecting element for detecting a temperature of said heater and a control part for controlling an electrical power supply to said first and second heat generating resistors so that the temperature detected by said temperature detecting element is maintained at a target temperature, wherein said temperature detecting element detects the temperature of said heater in a location apart from the region with the highest resistance value of said first heat generating resistor in the longitudinal direction.

6. An image heating apparatus according to claim 1, wherein a region with the highest resistance value of said first heat generating resistor is the approximate center in the longitudinal direction of said first heat generating resistor.

7. An image heating apparatus according to claim 6, wherein the conveyance reference of the recording material is within the region with the highest resistance value of said first heat generating resistor.

8. An image heating apparatus according to claim 1, wherein the region with the highest resistance value of said first heat generating resistor is located apart from the center in the longitudinal direction of said first heat generating resistor.

9. An image heating apparatus according to claim 8, where the conveyance reference of the recording material is one end part of said first heat generating resistor.

10. An image heating apparatus according to claim 1, wherein the summed resistance value of said first and second heat generating resistors is approximately even throughout the longitudinal direction.

11. An image heating apparatus according to claim 1, wherein the resistance value increased percentage of the high resistance part of said second heat generating resister is 50 to 90%.

12. An image heating apparatus according to claim 1 further comprising a flexible sleeve of which an internal surface is in contact with said heater, and a pressure roller for forming a nip portion with said heater through said flexible sleeve, wherein the recording material is heated while being pinched and conveyed in the nip portion.

13. A heater used for an image heating apparatus for heating an image formed on a recording material, comprising:

a substrate; and first and second heat generating resistors formed on said substrate;

wherein most of the region of said first heat generating resistor having smaller resistance value per unit length toward an end in the longitudinal direction of said substrate, and most of the region of said second heat generating resistor having larger resistance value per unit length toward the end; and wherein only said second heat generating resistor in said first and second heat generating resistors has a high resistance part corresponding to a safety element in a part in the longitudinal direction thereof.

14. A heater according to claim 13, wherein the high resistance part is a portion of said second heat generating resistor with the width in the direction perpendicular to the longitudinal direction being squeezed more than the both of adjacent portions in the longitudinal direction.

15. A heater according to claim 13, wherein the high resistance part of said second heat generating resistor is disposed in the same location as a region with the highest resistance value of said first heat generating resistor in the longitudinal direction.

16. A heater according to claim 13, wherein a region with the highest resistance value of said first heat generating resistor is the approximate center in the longitudinal direction of said first heat generating resistor.

17. A heater according to claim 13, wherein said the region with the highest resistance value of said first heat generating resistor is located apart from the center in the longitudinal direction of said first heat generating resistor.

18. A heater according to claim 13, wherein the summed resistance value of said first and second heat generating resistors is approximately even throughout the longitudinal direction.

19. A heater according to claim 13, wherein the resistance value increased percentage of the high resistance part is 50 to 90%.

20. An image heating apparatus for heating an image formed on a recording material, comprising:

a heater having a substrate and first and second heat generating resistors formed on said substrate, most of the region of said first heat generating resistor having smaller resistance value per unit length toward an end in the longitudinal direction of said substrate, and most of the region of said second heat generating resistor having larger resistance value per unit length toward the end;

wherein an electrical power supply to said first heat generating resistor and an electrical power supply to said second heat generating resistor are individually controllable, a safety element which operates in response to the heat of said heater to cut off electrical power supply to said first and second heat generating resistors; and wherein the both of said first and second heat generating resistors have high resistance part corresponding to said safety element in a part of the longitudinal direction thereof, and a resistance value increase percentage of the high resistance part of said second heat generating resistor is larger than that of the high resistance part of said first heat generating resistor.

21. An image heating apparatus according to claim 20, wherein the high resistance part is a portion of said first and second heat generating resistors with the width in the direction perpendicular to the longitudinal direction being squeezed more than the both of adjacent portions in the longitudinal direction.

22. An image heating apparatus according to claim 20, wherein said safety element is electrically connected a power supply with said first and second heat generating resistors.

23. An image heating apparatus according to claim 20, wherein the high resistance parts of said first and second heat generating resistors are disposed in locations apart from the region with the lowest resistance value of said second heat generating resistor, in the longitudinal direction.

24. An image heating apparatus according to claim 23, further comprising a temperature detecting element for detecting temperature of said heater and a control part for controlling an electrical power supply to said first and second heat generating resistors so that the temperature detected by said temperature detecting element is maintained at the target temperature, wherein said temperature detecting element detects the temperature of said heater in the longitudinal direction in a location approximately axisymmetric with the location where the high resistance part is disposed over the region with the lowest resistance value of said second heat generating resistor in the longitudinal direction.

25. An image heating apparatus according to claim 20, wherein a region with the highest resistance value of said first heat generating resistor is the approximate center in the longitudinal direction of said first heat generating resistor.

26. An image heating apparatus according to claim 25, wherein the conveyance reference of the recording material is within the region with the highest resistance value of said first heat generating resistor.

27. An image heating apparatus according to claim 20, wherein the region with the highest resistance value of said first heat generating resistor is located apart from the center in the longitudinal direction of said first heat generating resistor.

28. An image heating apparatus according to claim 27, where the conveyance reference of the recording material is one end part of said first heat generating resistor.

29. An image heating apparatus according to claim 20, wherein the summed resistance value of said first and second heat generating resistors is approximately even throughout the longitudinal direction.

30. An image heating apparatus according to claim 20, wherein the resistance value increased percentage of the high resistance part of said first heat generating resistor is 0 to 25% and the resistance value increased percentage of the high resistance part of said second heat generating resistor is 50 to 100%.

31. An image heating apparatus according to claim 20, further comprising a flexible sleeve of which an internal surface is in contact with said heater, and a pressure roller for forming a nip portion with said heater through said flexible sleeve, wherein the recording material is heated while being pinched and conveyed in the nip portion.

32. A heater used for an image heating apparatus for heating an image formed on a recording material, comprising:

a substrate; and first and second heat generating resistors formed on said substrate;

wherein most of the region of said first heat generating resistor having smaller resistance value per unit length toward an end in the longitudinal direction of said substrate, and most of the region of said second heat generating resistor having larger resistance value per unit length toward the end; and wherein the both of said first and second heat generating resistors have high resistance part corresponding to a safety element in a part in the longitudinal direction thereof and a resistance value increase percentage of the high resistance part of said second heat generating resistor is larger than that of the high resistance part of said first heat generating resistor.

33. A heater according to claim 32, wherein the high resistance part is a portion of said first and second heat generating resistors with the width in the direction perpendicular to the longitudinal direction being squeezed more than the both of adjacent portions in the longitudinal direction.

34. A heater according to claim 32, wherein the high resistance parts of said first and second heat generating resistors are disposed in locations apart from the region with the lowest resistance value of said second heat generating resistor in the longitudinal direction.

35. A heater according to claim 32, wherein a region with the highest resistance value of said first heat generating resistor is the approximate center in the longitudinal direction of said first heat generating resistor.

36. A heater according to claim 32, wherein said the region with the highest resistance value of said first heat generating resistor is located apart from the center in the longitudinal direction of said first heat generating resistor.

37. A heater according to claim 32, wherein the summed resistance value of said first and second heat generating resistors is approximately even throughout the longitudinal direction.

38. A heater according to claim 32, wherein the resistance value increased percentage of the high resistance part of said first heat generating resistor is 0 to 25% and the resistance value increased percentage of the high resistance part of said second heat generating resistor is 50 to 100%.

* * * * *

UNITED STATES PATENT AND TRADEMARK OFFICE

CERTIFICATE OF CORRECTION

PATENT NO. : 7,193,181 B2
APPLICATION NO. : 11/154546
DATED : March 20, 2007
INVENTOR(S) : Tomoyuki Makihira et al.

It is certified that error appears in the above-identified patent and that said Letters Patent is hereby corrected as shown below:

ON THE COVER PAGE ITEM 57
Abstract, line 16, “high resistance part” should be deleted.

COLUMN 1
Line 31, “paradium” should read --palladium--.
Line 40, “an” should read --a--.
Line 62, “do” should read --does--.
Line 63, “operating” should read --operate--.

COLUMN 2
Line 14, “an” should read --a--.
Line 16, “an” should read --a--.

COLUMN 3
Line 24, “an” should read --a--.
Line 26, “an” should read --a--.
Line 66, “parthigh resistance” should be deleted.

COLUMN 6
Line 37, “most” should read --most of the--.
Line 40, “most” should read --most of the--.

COLUMN 10
Line 41, “addition,” should read --addition--.
Line 57, “overrising” should read --over rising--.

COLUMN 13
Line 59, “short” should read --shorter--.

COLUMN 14
Line 5, “large” should read --large as--.
Line 35, “most” should read --most of the--.
Line 38, “most” should read --most of the--.

COLUMN 16
Line 10, “sheet” should read --sheets--.
Line 37, “termoswitch” should read --thermoswitch--.

COLUMN 17
Line 16, “selfevidently” should read --self-evidently--.

UNITED STATES PATENT AND TRADEMARK OFFICE

CERTIFICATE OF CORRECTION

PATENT NO. : 7,193,181 B2
APPLICATION NO. : 11/154546
DATED : March 20, 2007
INVENTOR(S) : Tomoyuki Makihira et al.

It is certified that error appears in the above-identified patent and that said Letters Patent is hereby corrected as shown below:

COLUMN 18
Line 13, “selfevidently” should read --self-evidently--.

COLUMN 19
Line 3, “0%<A(25%” should read --0%<A<25%--.
Line 4, “(B(100%” should read --<B<100%--.

COLUMN 20
Line 7, “most” should read --most of the--.
Line 10, “most” should read --most of the--.
Line 51, “almina” should read --alumina--.

COLUMN 21
Line 19, “and” should be deleted.

COLUMN 23
Line 34, “most” should read --most of the--.
Line 37, “most” should read --most of the--.

COLUMN 26
Line 6, “selfevidently” should read --self-evidently--.

COLUMN 28
Line 51, “most” should read --most of the--.
Line 54, “most” should read --most of the--.
Line 63, “have” should read --has--.

COLUMN 29
Line 62, “connected” should read --connected to--.

COLUMN 30
Line 36, “resister” should read --resistor--.

COLUMN 31
Line 8, “said” should be deleted.
Line 50, “connected” should read --connected to--.

UNITED STATES PATENT AND TRADEMARK OFFICE

CERTIFICATE OF CORRECTION

PATENT NO. : 7,193,181 B2
APPLICATION NO. : 11/154546
DATED : March 20, 2007
INVENTOR(S) : Tomoyuki Makihira et al.

It is certified that error appears in the above-identified patent and that said Letters Patent is hereby corrected as shown below:

COLUMN 33
Line 5, "said" should be deleted.

Signed and Sealed this

Sixth Day of May, 2008

JON W. DUDAS
*Director of the United States Patent and Trademark Office*